US008061362B2

(12) United States Patent
Mua et al.

(10) Patent No.: US 8,061,362 B2
(45) Date of Patent: Nov. 22, 2011

(54) SMOKELESS TOBACCO COMPOSITION

(75) Inventors: John-Paul Mua, Advance, NC (US); Luis Rosete Monsalud, Jr., Kernersville, NC (US); Darrell Eugene Holton, Jr., Clemmons, NC (US); James Neil Figlar, Clemmons, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 841 days.

(21) Appl. No.: 11/781,666

(22) Filed: Jul. 23, 2007

(65) Prior Publication Data

US 2009/0025738 A1 Jan. 29, 2009

(51) Int. Cl.

| | |
|---|---|
| ***A24B 1/02*** | (2006.01) |
| ***A24B 3/00*** | (2006.01) |
| ***A24B 9/00*** | (2006.01) |
| ***A24B 15/00*** | (2006.01) |

(52) U.S. Cl. ..... 131/300; 131/352; 131/347; 131/299

(58) Field of Classification Search ..... None
See application file for complete search history.

(56) References Cited

U.S. PATENT DOCUMENTS

| | | | | |
|---|---|---|---|---|
| 787,611 | A | 4/1905 | Daniels, Jr. | |
| 1,086,306 | A | 2/1914 | Oelenheinz | |
| 1,376,586 | A | 5/1921 | Schwartz | |
| 1,437,095 | A | 11/1922 | Delling | |
| 1,757,477 | A | 5/1930 | Rosenhoch | |
| 2,122,421 | A | 7/1938 | Hawkinson | |
| 2,148,147 | A | 2/1939 | Baier | |
| 2,170,107 | A | 8/1939 | Baier | |
| 2,274,649 | A | 3/1942 | Baier | |
| 2,739,600 | A * | 3/1956 | Staib, Jr. | 131/309 |
| 2,770,239 | A | 11/1956 | Prats et al. | |
| 3,353,541 | A | 11/1967 | Hind et al. | |
| 3,398,754 | A | 8/1968 | Tughan | |

(Continued)

FOREIGN PATENT DOCUMENTS

| | | |
|---|---|---|
| EP | 0 514 805 A2 | 11/1992 |

(Continued)

OTHER PUBLICATIONS

Brown & Williamson Tobacco Corporation; Research, Development & Engineering File Note, *pH Effects During Ammonia Processing/550*, Sep. 23, 1985, pp. 1-4.

*Primary Examiner* — Richard Crispino
*Assistant Examiner* — Phu Nguyen
(74) *Attorney, Agent, or Firm* — Womble Carlyle Sandridge & Rice, LLP

(57) ABSTRACT

The invention provides a process for preparing a tobacco composition suitable for use as a smokeless tobacco composition, the process including: providing a slurry comprising water and a tobacco material, the slurry comprising at least about 75% by weight water, based on the total weight of the slurry; heating the slurry to a temperature of at least about 60° C. for a time sufficient to pasteurize the tobacco material; adding an amount of a base to the slurry sufficient to raise the pH of the slurry to at least about 8.5, thereby forming a pH-adjusted slurry; and continuing to heat the pH-adjusted slurry to a temperature of at least about 60° C. for a time sufficient for the pH of the slurry to drop at least about 0.5 pH unit following the adding step.

18 Claims, 2 Drawing Sheets

U.S. PATENT DOCUMENTS 3,399,454 A 9/1968 Liska
3,483,874 A 12/1969 Hind
3,612,065 A 10/1971 Rosen
3,696,917 A 10/1972 Levi
3,760,815 A 9/1973 Deszyck
3,847,164 A 11/1974 Mattina et al.
3,851,653 A 12/1974 Rosen
3,889,689 A 6/1975 Rosen
4,131,117 A 12/1978 Kite et al.
4,143,666 A 3/1979 Rainer et al.
4,148,325 A 4/1979 Solomon et al.
4,150,677 A 4/1979 Osborne et al.
4,194,514 A 3/1980 Campbell
4,270,552 A 6/1981 Jenkins et al.
4,308,877 A 1/1982 Mattina
4,341,228 A 7/1982 Keritsis et al.
4,366,824 A 1/1983 Rainer et al.
4,388,933 A 6/1983 Rainer et al.
4,421,126 A 12/1983 Gellatly
4,513,756 A 4/1985 Pittman et al.
4,528,993 A 7/1985 Sensabaugh, Jr. et al.
4,534,372 A 8/1985 White
4,596,259 A 6/1986 White et al.
4,607,479 A 8/1986 Linden
4,624,269 A 11/1986 Story et al.
4,631,899 A 12/1986 Nielsen
4,641,667 A 2/1987 Schmekel et al.
4,660,577 A 4/1987 Sensabaugh et al.
4,674,519 A 6/1987 Keritsis et al.
4,706,692 A 11/1987 Gellatly
4,821,749 A 4/1989 Toft et al.
4,941,484 A 7/1990 Clapp et al.
4,962,774 A 10/1990 Thomasson et al.
4,967,771 A 11/1990 Fagg et al.
4,972,854 A 11/1990 Kiernan et al.
4,987,906 A 1/1991 Young et al.
4,987,907 A 1/1991 Townend
5,005,593 A 4/1991 Fagg
5,056,537 A 10/1991 Brown et al.
5,065,775 A 11/1991 Fagg
5,092,352 A 3/1992 Sprinkle, III et al.
5,099,864 A 3/1992 Young et al.
5,101,839 A 4/1992 Jakob et al.
5,121,757 A 6/1992 White et al.
5,131,414 A 7/1992 Fagg et al.
5,131,415 A 7/1992 Munoz et al.
5,143,097 A 9/1992 Sohn et al.
5,148,819 A 9/1992 Fagg
5,159,942 A 11/1992 Brinkley et al.
5,167,244 A 12/1992 Kjerstad
5,203,354 A 4/1993 Hickle
5,234,008 A 8/1993 Fagg
5,318,050 A 6/1994 Gonzalez-Parra et al.
5,325,877 A 7/1994 Young et al.
5,327,917 A 7/1994 Lekwauwa et al.
5,339,838 A 8/1994 Young et al.
5,343,879 A 9/1994 Teague
5,346,734 A 9/1994 Wydick, Jr.
5,360,022 A 11/1994 Newton et al.
5,360,024 A 11/1994 Greig
5,370,139 A 12/1994 Shu et al.
5,372,149 A * 12/1994 Roth et al. ..... 131/300
5,387,416 A 2/1995 White et al.
5,413,122 A 5/1995 Shu et al.
5,435,325 A 7/1995 Clapp et al.
5,445,169 A 8/1995 Brinkley et al.
5,501,237 A 3/1996 Young et al.
5,533,530 A 7/1996 Young et al.
5,584,306 A 12/1996 Beauman et al.
5,598,868 A 2/1997 Jakob et al.
5,715,844 A 2/1998 Young et al.
5,724,998 A 3/1998 Gellatly et al.
5,962,662 A 10/1999 Shu et al.
6,048,404 A 4/2000 White
6,162,516 A 12/2000 Derr
6,216,706 B1 4/2001 Kumar et al.
6,298,858 B1 10/2001 Coleman, III et al.
6,325,860 B1 12/2001 Coleman, III
6,428,624 B1 8/2002 Coleman, III et al.
6,510,855 B1 1/2003 Korte et al.
6,591,841 B1 7/2003 White et al.
6,695,924 B1 2/2004 Dube et al.
6,730,832 B1 5/2004 Dominguez et al.
6,834,654 B2 12/2004 Williams
6,895,974 B2 5/2005 Peele
6,953,040 B2 10/2005 Atchley et al.
7,025,066 B2 * 4/2006 Lawson et al. ..... 131/299
7,032,601 B2 4/2006 Atchley et al.
2004/0020503 A1 2/2004 Williams
2004/0118422 A1 6/2004 Lundin et al.
2004/0173228 A1 9/2004 Coleman, III
2004/0250821 A1 12/2004 Perfetti et al.
2005/0061339 A1 3/2005 Hansson et al.
2005/0098187 A1 5/2005 Grierson et al.
2005/0178398 A1 8/2005 Breslin et al.
2005/0244521 A1 11/2005 Strickland et al.
2006/0191548 A1 8/2006 Strickland et al.
2007/0062549 A1 3/2007 Holton, Jr. et al.
2007/0095356 A1 5/2007 Winterson et al.
2007/0186941 A1 8/2007 Holton, Jr. et al.
2008/0029110 A1 2/2008 Dube et al.
2008/0029116 A1 2/2008 Robinson et al.
2008/0029117 A1 2/2008 Mua et al.

FOREIGN PATENT DOCUMENTS

EP 0 565 360 A2 10/1993
EP 1 055 375 A1 11/2000
GB 171659 A 11/1921
WO WO 96/14763 A1 5/1996
WO WO 96/31255 A1 10/1996
WO WO 98/01233 A1 1/1998
WO WO 98/28993 A3 7/1998
WO WO 02/080707 A1 10/2002
WO WO 03/028492 A1 4/2003
WO WO 03/053175 A2 7/2003
WO WO 03/055337 A1 7/2003
WO WO 03/086119 A1 10/2003
WO WO 2004/095959 A1 11/2004
WO WO 2005/016036 A1 2/2005
WO WO 2005/041699 A2 5/2005
WO WO 2005/041699 A3 5/2005
WO WO 2005/046363 A3 5/2005
WO WO 2005/063060 A1 7/2005
WO WO 2006/065192 A1 6/2006
WO WO 2006/127772 A2 11/2006
WO WO 2007/037962 A1 4/2007
WO WO 2007/057789 A3 5/2007
WO WO 2007/057791 A2 5/2007

* cited by examiner

SMOKELESS TOBACCO COMPOSITION

FIELD OF THE INVENTION

The present invention relates to tobacco, and in particular, to the use of tobacco in a smokeless form.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; U.S. Pat. App. Pub. No. 2005/0244521 to Strickland et al.; PCT WO 04/095959 to Arnarp et al.; PCT WO 05/063060 to Atchley et al.; PCT WO 05/004480 to Engstrom; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al.; U.S. Pat. No. 7,032,601 to Atchley et al.; US Pat. Appl. Pub. Nos. 2005/0178398 to Breskin et al. and 2006/0191548 to Strickland et al.; PCT WO 05/041699; and U.S. patent application Ser. No. 11/461,633, filed Aug. 1, 2006, to Mua et al.; each of which is incorporated herein by reference. One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the tradenames Camel Snus Frost, Camel Snus Original and Camel Snus Spice by R. J. Reynolds Tobacco Company. Representative smokeless tobacco products also are marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, and Mammoth Cave by Conwood Sales Co., L.P. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

It would be desirable to provide an enjoyable form of a smokeless tobacco product, and to provide processes for preparing tobacco compositions for use in smokeless tobacco products.

SUMMARY OF THE INVENTION

The present invention relates to a smokeless tobacco product and processes for preparing a tobacco composition suitable for use in a smokeless tobacco product. The product includes a smokeless tobacco formulation that can take various forms, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials. In one embodiment, the smokeless tobacco product is in the form of a tobacco formulation disposed within a moisture-permeable container. The smokeless tobacco formulation preferably includes shredded, granular, or particulate particles of tobacco, and may include other ingredients, such as sweeteners, binders, colorants, pH adjusters, fillers, flavoring agents, disintegration aids, antioxidants, oral care additives, and preservatives.

In one aspect of the invention, the smokeless tobacco product includes at least one additive or ingredient disposed within a tobacco formulation, wherein the additive is in a form adapted to segregate, or otherwise create physical separation between, the additive and one or more other components of the tobacco formulation during normal conditions of storage and/or use. By separating certain additives from other components of the tobacco formulation, any one or more of various functional advantages can be realized such as an increase in storage stability, a reduction in chemical interactions within the tobacco formulation that can shorten shelf-life and/or degrade the sensory characteristics of the tobacco formulation, a minimization of the effect of certain additives on sensory characteristics of the tobacco formulation, and enhancement of the ability to adjust product characteristics (e.g., moisture content) at the time of manufacture without sacrificing storage stability.

Thus, the invention provides a smokeless tobacco product configured for insertion into the mouth of a user of the product, the tobacco product comprising a tobacco formulation in a form suitable for insertion into the mouth of a user and at least one additive contained within the tobacco formulation, the additive being present in a form that physically separates the additive from the tobacco formulation. Suitable forms designed to accomplish such separation, and hence promote inhibition of interaction of selected components during handling and storage, include encapsulated forms; strips, pellets, films, and the like having selected ingredients physically or chemically entrapped or suspended therein; and the like.

In one embodiment, an encapsulated form is used to separate the additive, the encapsulated form including a wall or barrier structure defining an inner region or payload that contains the additive. For example, the invention can include a tobacco formulation including a plurality of microcapsules containing an additive designed to enhance the sensory characteristics of the product or add functional advantages to the product. Use of additives in microencapsulated form can improve storage stability of the product, particularly the stability of the sensory profile of the product, and protect certain additives from degradation over time. Microencapsulation can also insulate the user from undesirable sensory characteristics associated with the encapsulated ingredient, such as certain fillers, or provide a milder sensory experience by extending the release of certain flavorants over time. Microencapsulation of water can allow the product to be produced, stored, and transported at a lower moisture level, which can reduce storage and transportation costs and improve storage stability of the product. Exemplary additives that can be microencapsulated or otherwise segregated within a tobacco formulation include water, flavorants (e.g., sweeteners or tobacco-containing flavorants), binders, colorants, pH adjusters, buffering agents, fillers, disintegration aids, humectants, antioxidants, oral care ingredients, preservatives, and additives derived from herbal or botanical sources.

A representative microcapsule embodiment has an outer cover, shell, or coating that envelopes a liquid or solid core region, and in certain embodiments, the microcapsule can have a generally spherical shape. By encapsulating an additive within the core region of a microcapsule, the ability of the additive to interact with other components of the tobacco formulation is reduced or eliminated, which can enhance the storage stability of the resulting product. The core region, which typically releases the additive when the outer shell undergoes some type of physical destruction, breakage, or other loss of physical integrity (e.g., through dispersion, softening, crushing, application of pressure, or the like), thereby provides for altering the sensory properties of the smokeless tobacco product. Thus, in many embodiments, the outer shell of the microcapsules is designed to rupture during use or is water soluble under conditions of normal use, such as under conditions of at least about 45 weight percent moisture based on the total weight of the smokeless tobacco product. However, in other embodiments, the shell region is not intended to break down during use and, instead, maintains its integrity and does not release the contents of the core region. The outermost moisture-permeable container preferably has the form of a pouch or bag, such as the type commonly used for the manufacture of snus products.

In one embodiment, a smokeless tobacco product configured for insertion into the mouth of a user of the product is provided, the tobacco product comprising a water-permeable pouch containing a tobacco formulation, the tobacco formulation comprising a tobacco material and a plurality of microcapsules dispersed within the tobacco material. The microcapsules preferably comprise an outer shell encapsulating an internal payload comprising an additive, such as water, flavorants (e.g., sweeteners or tobacco-containing flavorants), binders, colorants, pH adjusters, buffering agents, oral care additives, fillers, disintegration aids, humectants, antioxidants, preservatives, additives derived from herbal or botanical sources, or mixtures thereof.

In another embodiment, a smokeless tobacco product configured for insertion into the mouth of a user of the product is provided, the tobacco product comprising a water-permeable pouch containing a tobacco formulation, the tobacco formulation comprising a tobacco material and a plurality of microcapsules dispersed within the tobacco material, the plurality of microcapsules comprising an outer shell encapsulating an internal payload comprising an additive selected from the group consisting of water, a flavorant, and mixtures thereof. Preferred microencapsulated flavorants include tobacco-containing flavorants, such as tobacco extracts or particulate tobacco material, sweeteners (e.g., sweeteners containing neotame), and vanillin (optionally in a complexed form). When the microencapsulated additive is water, the moisture content of the tobacco formulation prior to use is preferably less than about 20 weight percent based on the total weight of the formulation, more preferably less than about 15 weight percent, and most preferably less than about 10 weight percent.

In yet another embodiment, the present invention provides a smokeless tobacco product comprising a water-permeable pouch containing a tobacco formulation, the tobacco formulation comprising a tobacco material and a plurality of microcapsules dispersed within the tobacco material, the plurality of microcapsules comprising an outer shell encapsulating an internal payload comprising a flavorant selected from a group consisting of a sweetener composition comprising neotame, a tobacco-containing flavorant, and mixtures thereof, wherein the microencapsulated flavorant is present in an amount of at least about 1 percent based on the weight of the dry tobacco formulation, and wherein the outer shell of the microcapsules is water-soluble under conditions of at least about 45 weight percent moisture, based on the total weight of the formulation.

In a further embodiment, the invention provides a smokeless tobacco product comprising a water-permeable pouch containing a tobacco formulation, the tobacco formulation comprising a tobacco material and a plurality of rupturable microcapsules dispersed within the tobacco material, the plurality of rupturable microcapsules comprising an outer shell encapsulating an internal payload comprising water, wherein the moisture content of the tobacco formulation prior to rupture of the microcapsules is no more than about 20 weight percent based on the total weight of the formulation.

In a still further embodiment, a smokeless tobacco product is provided comprising a water-permeable pouch containing a tobacco formulation, the tobacco formulation comprising a tobacco material and a plurality of microcapsules dispersed within the tobacco material, the plurality of microcapsules comprising an outer shell encapsulating an internal payload comprising an additive selected from the group consisting of a filler material, a buffering agent, an additive derived from an herbal or botanical source, and mixtures thereof.

Exemplary filler materials include vegetable fiber materials such as sugar beet fiber materials, oats or other cereal grain, bran fibers, starch, or other modified or natural cellulosic materials. The microencapsulated filler material is typically present in an amount of at least about 5 percent based on the weight of the dry formulation.

Preferred buffering agents buffer within a pH range of about 6 to about 10, and exemplary buffering agents include metal hydroxides, metal carbonates, metal bicarbonates, or mixtures thereof. The microencapsulated buffering agent is typically present in an amount of at least about 1 percent based on the dry weight of the formulation.

The additives derived from herbal or botanical sources suitable for use in the invention are often in the form of an oil or extract. Exemplary compounds that can be present in such additives include minerals, vitamins, isoflavones, phytoesterols, allyl sulfides, dithiolthiones, isothiocyanates, indoles, lignans, flavonoids, polyphenols, and carotenoids.

In a further embodiment, the invention provides a smokeless tobacco product comprising a water-permeable pouch containing a tobacco formulation, the tobacco formulation comprising a tobacco material and a plurality of microcapsules dispersed within the tobacco material, the plurality of microcapsules comprising an outer shell encapsulating an internal payload comprising a filler material, wherein the outer shell of the microcapsules is non-water soluble under conditions of at least about 45 weight percent moisture, based on the total weight of the formulation.

In many of the embodiments set forth above, the tobacco-containing portion (e.g., extruded or shaped tobacco products, tobacco contained within a pouch, and the like) is intended to be placed in the mouth of the tobacco user, such that the tobacco formulation within the tobacco-containing portion may be enjoyed by the user. During use of certain embodiments of the product of the present invention, the outer shell of the microcapsules within the tobacco-containing portion may be acted upon by moisture within the mouth of the user, broken, crushed, or otherwise acted upon to release its contents. After the tobacco user is finished using the smokeless tobacco product, the outer moisture-permeable pouch, if present, may be removed from the user's mouth for disposal. Alternatively, that outer pouch, when present, may be manufactured from a dissolvable or dispersible material, such that the tobacco formulation and the pouch may be ingested by the user. Residual components of the outer shell of the microcapsules may be dispersed within the mouth of the user for ingestion or remain within the used pouch for disposal.

In another aspect of the invention, processes for preparing a tobacco composition suitable for use as a smokeless tobacco composition are provided. These processes of the invention can be characterized as including a heat treatment step that can be viewed as a type of pasteurization adapted to degrade, destroy, or denature at least a portion of the microorganisms within the tobacco composition. In one embodiment, the process comprises providing a mixture comprising water and a tobacco material having a high moisture content (e.g., in the form of a slurry), such as a mixture comprising at least about 75% by weight water, based on the total weight of the mixture. The mixture is subjected to a heat treatment step for a time and at a temperature adapted to pasteurize the material (e.g., heating the mixture to a temperature of at least about 60° C. for a time sufficient to pasteurize the tobacco material). Thereafter, an amount of a base is added to the mixture sufficient to raise the pH of the mixture to the alkaline pH range (i.e., above 7.0), thereby forming a pH-adjusted mixture. In one embodiment, sufficient base is added to raise the pH of the mixture to at least about 8.5. During the base addition step and thereafter, it is preferable to continue heating the pH-adjusted mixture (e.g., to a temperature of at least about 60° C.) for a time sufficient for the pH of the mixture to drop at least about 0.5 pH unit following the base addition step.

The process can further include the step of adding a salt to the mixture prior to or during the heat treatment. For example, the salt addition step can comprise adding about 1 to about 5% by weight of sodium chloride, based on the dry weight of the tobacco material.

Following the base addition step, the mixture can be cooled (e.g., to a temperature of less than about 35° C.). A humectant can be added during or following the cooling step. Thereafter, if desired, the pH of the mixture can be readjusted with additional base (e.g., to a pH of about 8.0 or less), and the mixture can be dried (e.g., to a moisture content of no more than about 15% by weight, based on the total weight of the dried tobacco material). Flavorants, sweeteners, and additional moisture can be added to the dried tobacco material as desired (e.g., in an amount sufficient to raise the moisture content of the tobacco material to at least about 25% by weight).

In one particular embodiment of the process, the process includes: providing a slurry comprising water and a tobacco material, the slurry comprising at least about 80% by weight water, based on the total weight of the slurry; heating the slurry to a temperature of at least about 70° C. for at least about 30 minutes (or other suitable time that effectively provides the desired treatment); adding an amount of a base to the slurry sufficient to raise the pH of the slurry to at least about 9.0, thereby forming a pH-adjusted slurry; continuing to heat the pH-adjusted slurry to a temperature of at least about 60° C. for at least about 1.5 hours (or other suitable time that effectively provides the desired treatment); cooling the pH-adjusted slurry to about ambient temperature, the pH-adjusted slurry having a pH of at least about 8 at the time the cooling step begins; adding a humectant to the pH-adjusted slurry during or after the cooling step; and drying the pH-adjusted slurry at a temperature and for a time sufficient to decrease the moisture level of the tobacco material to less than about 15% by weight, based on the weight of the moist tobacco material.

Yet another exemplary process for preparing a tobacco composition suitable for use as a smokeless tobacco composition is provided. This process also includes a heat treatment step that can be viewed as a type of pasteurization treatment. In one embodiment, the process comprises providing a moist tobacco material having a first moisture content (e.g., having a moisture content of at least about 30% by weight, based on the total weight of the moist tobacco material), and heating the moist tobacco at a temperature (e.g., a temperature of at least about 85° C.) and for a time sufficient to pasteurize the tobacco material while maintaining the moist tobacco material at the same approximate moisture level (i.e., the first moisture content) or higher (e.g., a moisture content at a level of at least about 30% by weight). Thereafter, an amount of a base and water can be added to the moist tobacco material in an amount sufficient to raise the pH of the moist tobacco material to a pH in the alkaline pH range (e.g., at least about 8.7) and raise the moisture content of the tobacco material to a second moisture content (e.g., to at least about 40% by weight), thereby forming a pH-adjusted moist tobacco material. The process can include continuing to heat the pH-adjusted moist tobacco material at an elevated temperature (e.g., a temperature of at least about 55° C.) for a time sufficient for the pH of the moist tobacco material to decrease to a lower level within the alkaline pH range (e.g., to drop to less than about 8.5) while maintaining the moisture content at the same approximate moisture level (i.e., the second moisture content) or higher (e.g., at least about 40% by weight). The tobacco material can then be dried under suitable conditions of time and temperature to reduce the moisture content of the tobacco material (e.g., at a temperature of at least about 35° C. for a time sufficient to reduce the moisture content of the tobacco to less than about 35% by weight) while maintaining a pH in the alkaline range (e.g., at least about 7.6). The process can further comprise the step of adding a sweetener composition to the dried tobacco material.

In one embodiment, the moist tobacco material can comprise a mixture of a dry tobacco material having a moisture content of less than about 15% by weight and an aqueous solution of a salt, and such a mixture can be prepared by heating the dry tobacco material to an elevated temperature (e.g., at least about 60° C.) and adding an aqueous salt solution (e.g., a sodium chloride solution) to the heated tobacco material.

In one embodiment, the step of continuing to heat the pH-adjusted moist tobacco material comprises heating the pH-adjusted moist tobacco material at a temperature and moisture level sufficient to maintain a pH reduction rate of about 0.05 to about 0.15 pH units per hour.

In one particular embodiment, the invention provides a process for preparing a tobacco composition suitable for use as a smokeless tobacco composition, the process comprising: providing a moist tobacco material comprising a mixture of a tobacco material and a salt solution, the moist tobacco material having a moisture content of about 30% to about 40% by weight, based on the total weight of the moist tobacco material; heating the moist tobacco to a temperature of at least about 90° C. for at least about 1 hour (or other suitable time that effectively provides the desired treatment) to pasteurize the tobacco material while maintaining the moisture content at a level of about 30% to about 40% by weight; adding an amount of a base and water to the moist tobacco material sufficient to raise the pH of the slurry to at least about 8.7 and raise the moisture content to at least about 45% by weight, thereby forming a pH-adjusted moist tobacco material; continuing to heat the pH-adjusted moist tobacco material to a temperature of at least about 65° C. for at least about 1 hour (or other suitable time that effectively provides the desired treatment) while maintaining a moisture content of at least about 45% by weight and a pH of at least about 8; and drying the pH-adjusted tobacco material at a temperature of at least about 35° C. for a time sufficient to reduce the moisture content of the tobacco to less than about 35% by weight while maintaining a pH of at least about 7.6.

BRIEF DESCRIPTION OF THE DRAWINGS

In order to provide an understanding of embodiments of the invention, reference is made to the appended drawings, which are not necessarily drawn to scale, and in which reference numerals refer to components of described exemplary embodiments of the invention. The drawings are exemplary only, and should not be construed as limiting the invention.

DETAILED DESCRIPTION OF THE PREFERRED EMBODIMENTS

The present inventions now will be described more fully hereinafter with reference to the accompanying drawing. The inventions may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Certain embodiments of the invention will be described with reference to the accompanying drawings, and these described embodiments involve snus-type products having an outer pouch and containing microcapsules within the tobacco formulation. As explained in greater detail below, such embodiments are exemplary only, and the smokeless tobacco product can include tobacco compositions in other forms and can include additives encapsulated or otherwise segregated from other components of the tobacco formulation using methods other than microencapsulation.

Figure 1:
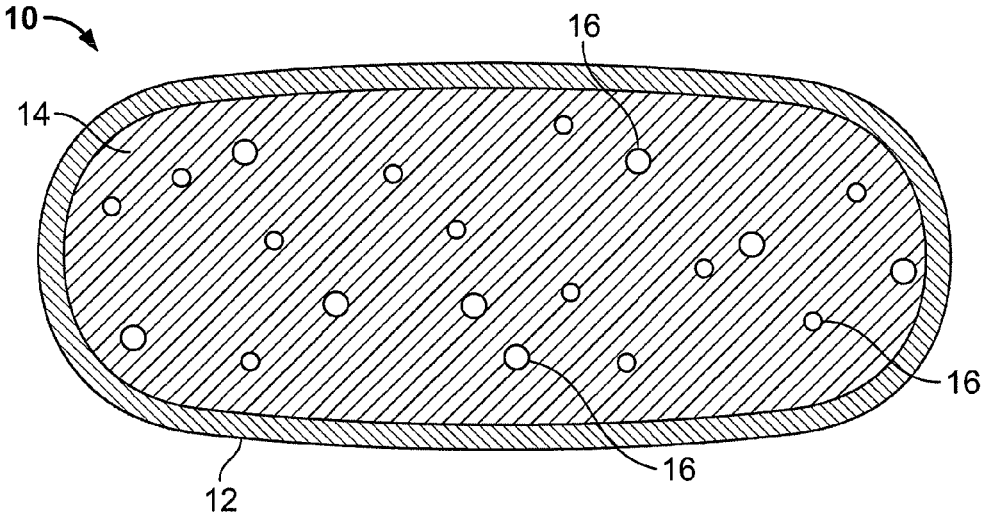
FIG. 1 is a cross-sectional view of a smokeless tobacco product embodiment, taken across the width of the product, showing an outer pouch filled with tobacco material and microcapsules disposed in the tobacco material.

Referring to FIG. 1, there is shown a first embodiment of a smokeless tobacco product 10. The tobacco product 10 includes a moisture-permeable container in the form of a pouch 12, which contains a solid tobacco filler material 14 of a type described herein. The smokeless tobacco product also comprises a plurality of microcapsules 16 dispersed within the tobacco filler material 14, the microcapsules containing an additive such as described in greater detail below.

Figure 2:
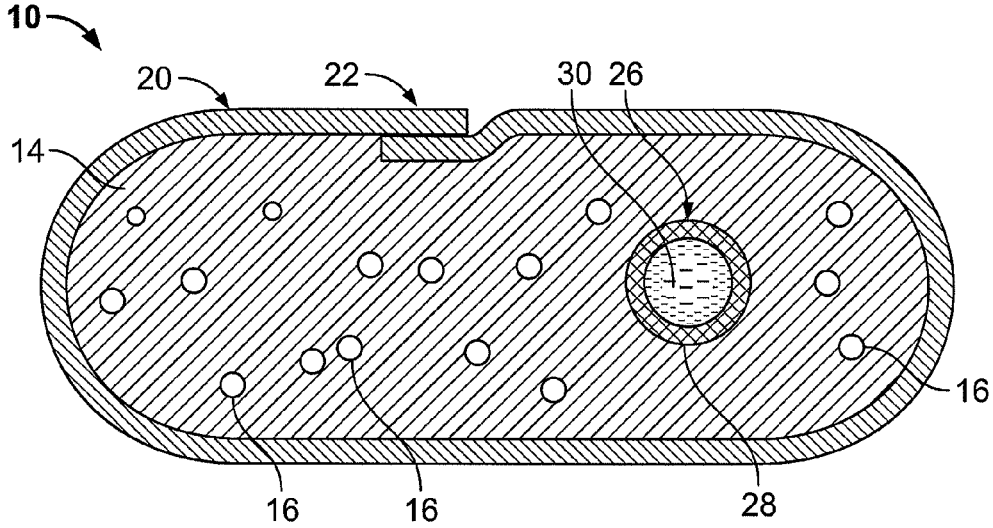
FIG. 2 is a cross-sectional view of a second smokeless tobacco product embodiment, taken across the width of the product, showing an outer pouch, tobacco material contained within the pouch, with microcapsules and a larger spherical capsule (also shown in cross-section) also contained within the pouch.

Referring to FIG. 2, there is shown a second embodiment of a smokeless tobacco product 10. The tobacco product 10 includes a container pouch 20. A preferred pouch comprises a moisture permeable mesh material. The illustrated container pouch 20 is sealed closed along its length at an overlap region 22. The overlap region may be formed by sealing the bottom portion of one edge of the pouch 20 over the top portion of the opposite edge of the pouch (e.g., by heat sealing, suitable adhesive, or other suitable means). A solid tobacco material 14 is disposed within the pouch 20, and a plurality of microcapsules 16 are dispersed within the tobacco material. Also disposed within the pouch 20 is an optional larger spherical capsule 26. The spherical capsule 26 has an outer shell 28 that contains an inner payload 30.

Figure 3:
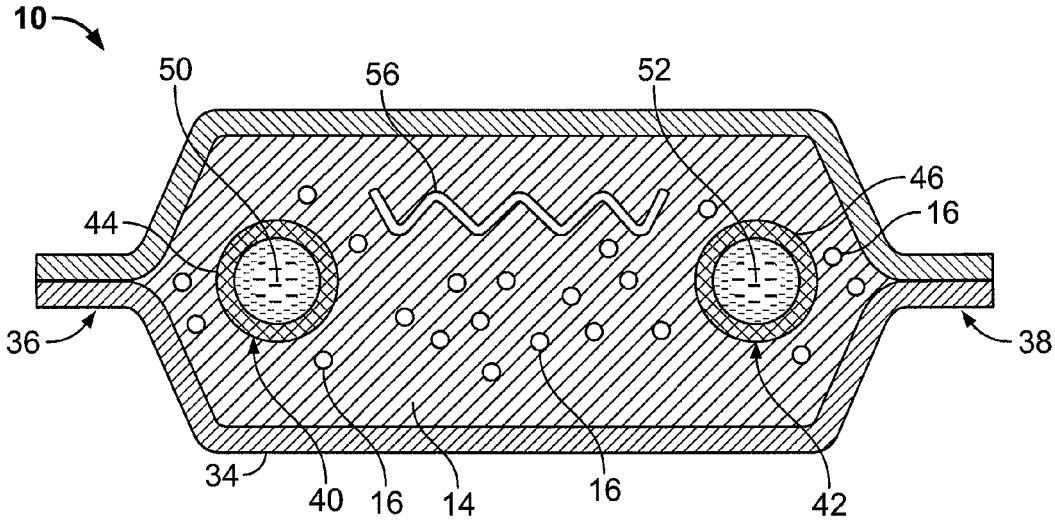
FIG. 3 is a cross-sectional view of a third smokeless tobacco product embodiment, taken across the length of the product, showing an outer pouch and tobacco material, microcapsules, a flavor sheet, and two larger spherical capsules (also shown in cross-section) contained within the pouch.

Referring to FIG. 3, there is shown a third embodiment of a smokeless tobacco product 10. The tobacco product 10 includes a container pouch 34. A preferred pouch comprises a moisture permeable mesh material. The illustrated pouch 34 is sealed shut at its ends 36, 38 (e.g., by heat-sealing, a suitable adhesive, or other suitable sealing means). A tobacco material 14 is contained within the pouch 34, and dispersed within the tobacco material are a plurality of microcapsules 16. Also contained within the pouch 34 are two optional larger spherical capsules 40 and 42. Each of the spherical capsules 40, 42 has an outer shell 44, 46 that contains an inner payload 50, 52. An optional dissolvable strip of a flavored material, shown as a flavor sheet 56 is included in the pouch as well. In certain alternative embodiments, a strip of flavored material such as the flavor sheet 56 may be disposed in a pouch 34 without any larger capsules being present.

Figure 4:
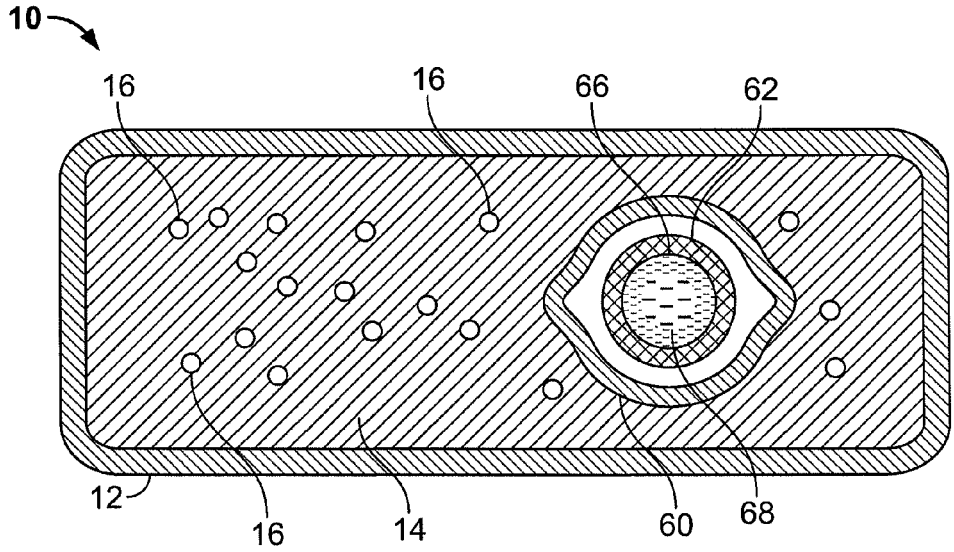
FIG. 4 is a cross-sectional view of a fourth smokeless tobacco product embodiment, taken across the length of the product, showing an outer pouch, an inner pouch, tobacco material, and microcapsules, with a larger capsule contained in the inner pouch.

Referring to FIG. 4, there is shown a fourth embodiment of a smokeless tobacco product 10. The tobacco product 10 includes an outer pouch 12 and an inner pouch 60. Preferred pouches each comprise a moisture permeable mesh material, and the pouches 12, 60 are illustrated without showing a seam that may be present in pouches containing a flavor agent member such as a larger capsule (e.g., a macro-sized capsule), as well as pouches without larger capsules. The outer pouch 12 forms a continuous container around a tobacco material 14 having microcapsules 16 dispersed therein. The inner pouch 60 is disposed within the outer pouch 12 and is generally surrounded by the tobacco material 14, although the inner pouch 60 may also be in contact with, adhered to, or formed continuously with the outer pouch 12. The inner pouch 60 contains a larger capsule 62 with an outer shell 66 and an inner payload 68. Although the inner pouch 60 is shown with interior space surrounding the capsule 62 for purposes of clarity in illustration, in preferred aspects of this embodiment the inner pouch 60 will be closely fitted around its contents. In an alternative embodiment, the inner pouch may contain a flavor strip such as a dissolvable flavor strip (for example, a Cinnamon Oral Care Strip available in Listerine PocketPaks from Pfizer, Inc.).

The smokeless tobacco product of the invention can include at least one additive or ingredient of the tobacco composition in a form that physically separates or segregates, to a certain extent, the additive from one or more other components of the tobacco composition. The functional advantage of such a separation can vary, but typically involves the minimization or elimination of chemical interaction between the additive and other components of the tobacco composition during conditions of normal storage and/or use. Separation of certain additives can thus enhance storage stability of the resulting tobacco product and/or preserve the desirable sensory characteristics of the product. The means of separation can take various forms, including encapsulation of the additive or use of the additive in various forms such as beads, pellets, rods, films, strands, layered or laminate structures, sheets, strips, or other shaped items. The additive can be dispersed within a matrix material and shaped into a desired form. The additive can also be physically entrapped or encapsulated within a seam of a pouch housing the tobacco composition.

In one embodiment, the additive is in an encapsulated form comprising an outer wall or barrier structure and an inner region containing the additive. For example, certain embodiments of the invention, such as those set forth in FIGS. 1-4, include a plurality of microcapsules, the microcapsules including an inner or core region encapsulated by an outer shell region. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product, such as addition of an antioxidant or immune system enhancing function. The outer shell or coating of the microcapsules serves as a barrier between the payload and the tobacco composition of the smokeless tobacco product. Depending on the desired application, this barrier can be permanent, meaning it is intended to remain in place as a barrier during the life of the product, or temporary, meaning the barrier is designed to stop serving as a barrier, and thereby release the payload, under certain conditions of product use.

In many embodiments, the additive in the core region is released when the outer shell undergoes some type of physical destruction, breakage, or other loss of physical integrity (e.g., through disintegration, softening, crushing, application of pressure, or the like), and thereby alters the sensory or functional properties of the smokeless tobacco product during use of the product. Thus, for example, the microcapsules may be incorporated within the pouch along with the tobacco formulation, and during use, contact of the microcapsules with moisture present in the user's mouth may cause the microcapsules to soften, lose their physical integrity, and release the additive within the user's mouth. Alternatively, the microcapsules may be purposefully crushed by application of pressure to release the additive. Such a release of the additive may alter or enhance the flavor or other sensory characteristics of the product, extend the period of time that a user may enjoy the product, or provide other functional advantages. In other embodiments, the shell is not designed to release the additive under conditions of normal use, such as in the case of microencapsulated filler materials.

The tobacco product 10 is typically used by placing one pouch containing the tobacco formulation in the mouth of a human subject/user. During use, saliva in the mouth of the user causes some of the components of the tobacco formulation to pass through the water-permeable pouch and into the mouth of the user. The pouch preferably is not chewed or swallowed. The user is provided with tobacco flavor and satisfaction, and is not required to spit out any portion of the tobacco formulation. In addition, in many embodiments, the microcapsules undergo destruction during use of the product, and the contents of the microcapsules are introduced into the mouth of the user. After about 10 minutes to about 60 minutes, preferably about 15 minutes to about 45 minutes, of use/enjoyment, the contents of the microcapsules and substantial amounts of the tobacco formulation have been ingested by the human subject, and the pouch may be removed from the mouth of the human subject for disposal.

Exemplary types of additives that can be separated from other components of the tobacco formulation by encapsulation (e.g., included in the payload of microcapsules) or other techniques include water, flavorants, tobacco material (e.g., tobacco material in particulate form or in the form of a tobacco extract), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives, preservatives (e.g., potassium sorbate, and the like), syrups (e.g., honey, high fructose corn syrup, and the like used as flavorants), disintegration aids (e.g., microcrystalline cellulose, croscarmellose sodium, crospovidone, sodium starch glycolate, pregelatinized corn starch, and the like), additives derived from an herbal or botanical source, and mixtures thereof. Representative types of payload components also are set forth in U.S. Pat. No. 5,387,416 to White et al.; U.S. Pat. App. Pub. No. 2005/0244521 to Strickland et al.; U.S. Pat. Appl. Pub. No. 2004/0261807 to Dube et al. and PCT WO 05/041699 to Quinter et al., each of which is incorporated herein by reference.

Exemplary flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. Flavorants may be natural or synthetic, and the character of these flavors imparted thereby may be described, without limitation, as fresh, sweet, herbal, confectionary, floral, fruity or spice. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., *Tobacco Flavoring for Smoking Products*, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single microcapsule as a mixture, or as separate components of separate microcapsules.

In one preferred embodiment, the segregated additive, such as an additive in the payload of the microcapsules, is a tobacco-based flavorant composition, such as a flavorant comprising particulate tobacco material or a tobacco extract (e.g., an aqueous tobacco extract in solid form). Any of the kinds of tobacco material set forth herein could be used as a microencapsulated flavorant. The use of a microencapsulated tobacco flavorant can provide the smokeless tobacco formulation with extended release flavor characteristics. Some forms of smokeless tobacco formulations deliver a strong sensory profile. By microencapsulating a portion of the tobacco material in the formulation, a milder sensory experience can be achieved. Microencapsulation of a tobacco flavorant can also extend the sensory experience by providing a slow continuous release of tobacco flavor over time as the product resides in the mouth. Preferred microencapsulated tobacco flavorants will provide extended release of the tobacco flavorant under conditions of normal use of the smokeless tobacco product, such as under conditions of a 45% or greater moisture level, based on the total weight of the smokeless tobacco product.

Tobacco extracts useful as components of the tobacco formulation, and in particular, extracts suitable for use as the segregated additive can be employed. Extracts can be used in solid form (e.g., spray-dried or freeze-dried form), in liquid form, in semi-solid form, or the like. Exemplary tobacco extracts and extraction techniques are set forth, for example, in U.S. Pat. No. 4,150,677 to Osborne, Jr. et al.; U.S. Pat. No. 4,967,771 to Fagg et al.; U.S. Pat. No. 5,005,593 to Fagg et al.; U.S. Pat. No. 5,148,819 to Fagg; and U.S. P*at*. N*o*. 5,435,325 to Clapp et al., all of which are incorporated by reference herein. Various tobacco extraction and reconstitution methodologies are set forth in U.S. Pat. No. 5,065,775 to Fagg; U.S. Pat. No. 5,360,022 to Newton; and U.S. Pat. No. 5,131,414 to Fagg, all of which are incorporated by reference herein. See also, the tobacco extract treatment methodologies set forth in U.S. Pat. No. 5,131,415 to Munoz et al. and U.S. Pat. No. 5,318,050 to Gonzalez-Parra, both of which are incorporated by reference herein.

Suitable known reconstituted tobacco processing techniques, such as paper-making techniques or casting-type processes, can be employed. See, for example, the types of paper-making processes set forth in U.S. Pat. No. 3,398,754 to Tughan; U.S. Pat. No. 3,847,164 to Mattina; U.S. Pat. No. 4,131,117 to Kite; U.S. Pat. No 4,270,552 to Jenkins; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; 4,962,774 to Thomasson; U.S. Pat. No. 4,941,484 to Clapp; U.S. Pat. No. 4,987,906 to Young; U.S. Pat. No. 5,056,537 to Brown; U.S. Pat. No. 5,143,097 to Sohn; U.S. Pat. No. 5,159,942 to Brinkley et al.; U.S. Pat. No. 5,325,877 to Young; U.S. Pat. No. 5,445,169 to Brinkley; U.S. Pat. No. 5,501,237 to Young; U.S. Pat. No. 5,533,530 to Young; which are incorporated herein by reference. See, for example, the casting processes set forth in U.S. Pat. No. 3,353,541 to Hind; U.S. Pat. No. 3,399,454 to Hind; U.S. Pat. No. 3,483,874 to Hind; U.S. Pat. No. 3,760,815 to Deszyck; U.S. Pat. No. 4,674,519 to Keritsis; U.S. Pat. No. 4,972,854 to Kiernan; U.S. Pat. No. 5,023,354 to Hickle; U.S. Pat. No. 5,099,864 to Young; U.S. Pat. No. 5,101,839 to Jakob; U.S. Pat. No. 5,203,354 to Hickle; U.S. Pat. No. 5,327,917 to Lekwauwa; U.S. Pat. No. 5,339,838 to Young; U.S. Pat. No. 5,598,866 to Jakob; U.S. Pat. No. 5,715,844 to Young; U.S. Pat. No. 5,724,998 to Gellatly; and U.S. Pat. No. 6,216,706 to Kumar; and EPO 565360; EPO 1055375 and PCT WO 98/01233; which are incorporated herein by reference. Extracts, extracted materials, and slurries used in traditional types of reconstituted tobacco processes can be employed as ingredients in tobacco formulations for the smokeless tobacco products described herein.

In another embodiment, the segregated additive, such as an additive in the payload of the microcapsules, comprises vanillin as a flavorant. Under certain conditions, such as at a basic pH, the presence of vanillin in a smokeless tobacco formulation can lead to reddish staining of the pouch over time. By microencapsulating vanillin, the vanillin is stabilized in the smokeless tobacco product and the possibility of staining of the pouch is reduced. In certain embodiments, the microencapsulated vanillin can be in the form of a complexed vanillin that releases vanillin over time, such as ethylvanillin glucoside. In preferred embodiments, the microencapsulated vanillin will provide extended release of vanillin during conditions of normal use, such as under conditions of a 45% or greater moisture level.

In another embodiment, the segregated additive, such as an additive in the payload of the microcapsules, is a natural and/or artificial sweetener, such as SUCRASWEET® brand sweetener available from Sweetener Solutions Company. SUCRASWEET® is a combination of neotame, acesulfame potassium, and maltitol. It is possible for certain sweeteners, particularly sweeteners containing neotame, to exhibit a lack of stability under certain conditions, such as basic pH. Certain sweeteners can chemically breakdown to form byproducts that can alter the sensory characteristics of the smokeless tobacco formulation in an undesirable manner, such as by increasing bitterness. By microencapsulating such sweeteners, breakdown of the sweetener flavorant can be reduced or avoided and the desired sensory profile of the smokeless tobacco product can be preserved for a longer period of time. In preferred embodiments, the microencapsulated sweetener flavorant will provide a continuous and extended release of flavorant and exhibit water-solubility during conditions of normal use, such as under conditions of a 45% or greater moisture level.

In yet another embodiment, the segregated additive, such as an additive in the payload of the microcapsules, is water, which serves to increase the moisture level of the smokeless tobacco product. By adding microencapsulated or otherwise segregated water to a smokeless tobacco product, the moisture level of the product during storage can be reduced. Upon placement of the product in the mouth, the microencapsulated water preferably provides a rapid release of water. Rather than being designed to dissolve over time during product use, the outer shell of the microcapsules in this embodiment are preferably designed to rupture during use, such as by crushing of the microcapsules by the user, thereby resulting in rapid release of water in the product at any time during or before use of the product. The ability to package, store, and transport a smokeless tobacco product at a lower moisture level reduces transportation costs (e.g., elimination of the need for refrigeration) and increases the shelf-life of the product. The use of microencapsulated water is particularly suitable for tobacco formulations having a moisture content, prior to use (e.g., during storage), of less than about 20 weight percent, frequently less than about 15 weight percent, and often less than about 10 weight percent, based on the total weight of the tobacco formulation. A typical moisture content range for the tobacco formulation in this embodiment is about 5 to about 20 weight percent.

The additive can also be in the form of isolated components (e.g., oils or extracts) from botanical or herbal sources, such as potato peel, grape seed, ginseng, gingko biloba, Saint John's Wort, saw palmetto, green tea, black tea, black cohosh, cayenne, chamomile, cranberry, echinacea, garlic, evening primrose, feverfew, ginger, goldenseal, hawthorn, kava, licorice, milk thistle, uva ursi, or valerian. Additives, such as the oils and extracts noted above, often include compounds from various classes known to provide certain bioactive effects, such as minerals, vitamins, isoflavones, phytoesterols, allyl sulfides, dithiolthiones, isothiocyanates, indoles, lignans, flavonoids, polyphenols, and carotenoids. Exemplary compounds found in these types of extracts or oils include ascorbic acid, peanut endocarb, resveratrol, sulforaphane, beta-carotene, lycopene, lutein, co-enzyme Q, carnitine, quercetin, kaempferol, and the like. See, e.g., Santhosh et al., Phytomedicine, 12(2005) 216-220, which is incorporated herein by reference. The oil or extract additives used in the present invention may comprise, without limitation, any of the compounds and sources set forth herein, including mixtures thereof. Certain additives of this type are sometimes referred to as dietary supplements, nutraceuticals, "phytochemicals" or "functional foods". These types of additives are sometimes defined in the art as encompassing substances typically available from naturally-occurring sources (e.g., plant materials) that provide one or more advantageous biological effects (e.g., health promotion, disease prevention, or other medicinal properties), but are not classified or regulated as drugs.

In embodiments of the invention including a microencapsulated or otherwise segegated component derived or isolated from a botanical or herbal source, the microencapsulated additive can add advantageous biological functions to the product, such as immune system boosting effects, antioxidant effects, and the like. Microencapsulation can increase the probability that the bioactive additive will remain in an active form until the product is used. In preferred embodiments, the microencapsulated bioactive additive will provide a continuous and extended release of the additive and exhibit water-solubility during conditions of normal use, such as at a 45% or greater moisture level.

In a further embodiment, the segregated additive, such as an additive in the payload of the microcapsules, may comprise a buffering agent, such as sodium bicarbonate and/or sodium carbonate. Suitable buffering agents typically buffer at a pH of at least about 6.0, often at least about 7.0, and frequently at least about 7.5. Suitable buffering agents typically buffer at a pH of less than about 10.0, often less than about 9.5, and frequently less than about 9.0. For optimal sensory characteristics, it is preferable to maintain the pH of the smokeless tobacco formulation above about 7.5. However, over time, it is possible for the pH of a smokeless tobacco formulation to decline, particularly at higher than ambient temperatures. Use of a microencapsulated buffering agent that provides extended release can aid in maintaining the product pH in a desired range, which results in a more consistent sensory profile for the product and extends shelf-life. In certain preferred embodiments, the microencapsulated buffering agent will release buffering agent as the temperature of the product exceeds a certain temperature threshold (e.g., about 80° F. or about 27° C.) or when the product pH decreases to an undesirably low level (e.g., 7.3 or less).

In a still further embodiment, the segregated additive, such as an additive in the payload of the microcapsules, is a filler material. Certain filler materials can impart less desirable sensory characteristics to the smokeless tobacco product. For example, certain fillers may have a grainy or mealy texture or taste. Microencapsulation, or otherwise achieving physical separation, of the filler can serve to minimize the effect of the sensory characteristics of the filler on the overall sensory profile of the smokeless tobacco product. In this manner, fillers can be advantageously employed when a milder product taste is desired without imparting any taste off-notes. A particularly preferred filler is FIBREX® brand filler available from International Fiber Corporation, which is a fiber material derived from sugar beets. Other suitable filler materials include oats or other cereal grain, bran fibers, starch, or other modified or natural cellulosic materials. In preferred embodiments, the microencapsulated filler is in a non-water soluble form under conditions of normal use, such as at a moisture level of 45% or greater by weight.

As noted previously, for many embodiments, it is preferable for the outer shell of the microcapsules to lose physical integrity under conditions of normal use in the mouth of the user, such as under conditions of relatively high moisture (e.g., above 45% moisture based on the total weight of the smokeless tobacco product). In other embodiments, it is preferably for the outer shell of the microcapsules to lose physical integrity when the smokeless tobacco product reaches a certain pH, such as a pH at or below about 7.3, or a certain temperature, such as at or above about 27° C. In still further embodiments, the microcapsules are designed to rupture when acted upon by physical force or pressure by the user, either through pressure applied by hand prior to insertion of the product in the mouth or through pressure applied after the product is inserted into the oral cavity (e.g., pressure applied by the tongue or teeth).

The microcapsule payload can have a form that can vary. Typically, the payload has the form of a liquid or gel, although the payload can be in the form of a solid (e.g., a crystalline material or a dry powder). In one embodiment, the payload is a mixture of the additive (e.g., a flavoring agent) and a diluting agent or carrier (e.g., water). A preferred diluting agent is a triglyceride, such as a medium chain triglyceride, and more particularly a food grade mixture of medium chain triglycerides. See, for example, Radzuan et al., Porim Bulletin, 39, 33-38 (1999).

The amount of additive and diluting agent within the microcapsule may vary. In some instances, the diluting agent may be eliminated altogether, and the entire payload can be composed of the additive. Alternatively, the payload can be almost entirely comprised of diluting agent, and only contain a very small amount of relatively potent additive. In one embodiment, the composition of the mixture of additive and diluting agent is in the range of about 5 percent to about 99 percent additive, and more preferably in the range of about 5 to about 75 percent additive, and most preferably in the range of about 10 to about 25 percent additive, by weight based on the total weight of the payload, with the balance being diluting agent. The exact amount of additive will depend on several factors including the additive type and the desired sensory profile of the product.

The crush strength of the microcapsules is sufficient to allow for normal handling and storage without significant degree of premature or undesirable breakage. Providing capsules that possess both suitable integrity during storage and the ability to rupture or otherwise break down at the time of use can be determined by experimentation, depending upon factors such as capsule size and type, and is a matter of design choice. See, for example, U.S. Pat. Pub. No. 2007/0068540 to Thomas et al., which is incorporated herein by reference.

An exemplary microcapsule may include an outer shell incorporating a material such as wax, gelatin, cyclodextrin, or alginate, and an inner payload incorporating an aqueous or non-aqueous liquid (e.g., a solution or dispersion of at least one flavoring ingredient within water or an organic liquid such as an alcohol or oil; or a mixture of water and a miscible liquid like alcohol or glycerin). Thus, for example, a plurality of such microcapsules may be incorporated within the pouch along with the tobacco formulation; and during use of the product, a crushing or other physical destruction of the microcapsules may allow the microcapsules to release the additive contained therein to provide suitable moistening of components of the tobacco formulation, as well as provide other functional benefits such as enhanced taste. For example, a suitable number of capsules having outer shells comprising a food grade waxy substance and an inner payload comprising water may be incorporated within a pouch such that, upon rupture of those capsules, sufficient water is released to provide a desired moistening effect upon the tobacco formulation.

The microcapsules used in the smokeless tobacco product of the invention may be uniform or varied in size, weight, and shape, and such properties of the microcapsules will depend upon the desired properties of the smokeless tobacco product. A representative microcapsule is generally spherical in shape. However, suitable microcapsules may have other types of shapes, such as generally rectilinear, oblong, elliptical, or oval shapes. Exemplary microcapsules may have diameters of less than about 100 microns, such as microcapsules having diameters in the range of about 1 to about 40 microns, or about 1 micron to about 20 microns.

The number of microcapsules incorporated into the smokeless tobacco product can vary, depending upon factors such as the size of the microcapsules, the character or nature of the additive in the payload, the desired attributes of the smokeless tobacco product, and the like. The number of microcapsules incorporated within smokeless tobacco product can exceed about 5, can exceed about 10, can exceed about 20, can exceed about 40, and can even exceed about 100. In certain embodiments, the number of capsules can be greater than about 500, and even greater than about 1,000.

The total weight of the microcapsules contained within the smokeless tobacco product may vary, but is typically greater than about 10 mg, often greater than about 20 mg, and can be greater than about 30 mg. The total weight of the microcapsules is typically less than about 200 mg, often less than about 100 mg, and can be less than about 50 mg.

The relative weight of the microcapsules in the pouch may vary. Typically, the dry weight of the tobacco within the smokeless tobacco product is greater than the weight provided by microcapsule components. However, the weight of microcapsule components can range from about 10 percent to about 75 percent, often about 20 percent to about 50 percent, based on the combined weight of microcapsule components and dry weight of tobacco.

If desired, microcapsules of different sizes and/or of different types (e.g., differing shell materials, differing shell properties such as shape or hardness and/or differing capsule-contained components) may be incorporated within the product. In this manner, different microcapsules may be incorporated into the product to provide desired properties (e.g., mouthfeel, flavor, other sensory effect), and/or to provide release of encapsulated components at different times during the use of the product. For example, a first flavoring ingredient may be released from a first set of microcapsules upon initial introduction of the product to a user's mouth, and a second flavoring ingredient, contained in a second set of microcapsules, may not be released until a later time (e.g., a semi-soluble coating of the second capsules takes longer to rupture than the coating of the first capsule set).

The microcapsules of the invention can be formed using any microencapsulating technology known in the art. For example, the microcapsules can be formed using any of various chemical encapsulation techniques such as solvent evaporation, solvent extraction, organic phase separation, interfacial polymerization, simple and complex coacervation, in-situ polymerization, liposome encapsulation, and nanoencapsulation. Alternatively, physical methods of encapsulation could be used, such as spray coating, pan coating, fluid bed coating, annular jet coating, spinning disk atomization, spray cooling, spray drying, spray chilling, stationary nozzle coextrusion, centrifugal head coextrusion, or submerged nozzle coextrusion.

Coacervation is a colloid phenomenon that begins with a solution of a colloid in an appropriate solvent. Depending on the nature of the colloid, various changes can bring about a reduction of the solubility of the colloid. As a result of this reduction, a significant portion of the colloid can be separated out into a new phase, thus forming a two phase system, with one being rich and the other being poor in colloid concentration. The colloid-rich phase in a dispersed state appears as amorphous liquid droplets called coacervate droplets. Upon standing, these coalesce into one clear homogenous colloid-rich liquid layer, known as the coacervate layer, which can be deposited so as to produce the wall material of the resultant microcapsules.

Simple coacervation can be effected either by mixing two colloidal dispersions, one having a high affinity for water, or it can be induced by adding a strongly hydrophilic substance such as alcohol or sodium sulfate. A water soluble polymer is concentrated in water by the action of a water miscible, non-solvent for the emerging polymer (e.g., gelatin) phase. Ethanol, acetone, dioxane, isopropanol and propanol are exemplary solvents that can cause separation of a coacervate such as gelatin, polyvinyl alcohol, or methyl cellulose. Phase separation can be effected by the addition of an electrolyte such as an inorganic salt to an aqueous solution of a polymer such as gelatin, polyvinyl alcohol, or carboxymethylcellulose.

Complex coacervation can be induced in systems having two dispersed hydrophilic colloids of opposite electric charges. Neutralization of the overall positive charges on one of the colloids by the negative charge on the other is used to bring about separation of the polymer-rich complex coacervate phase. The gelatin-gum arabic (gum acacia) system is one known complex coacervation system.

Organic phase separation is sometimes more simply referred to as "water-in-oil" microencapsulation. In this case, the polar core is dispersed into an oily or non-polar continuous medium. The wall material is then dissolved in this continuous medium.

Regardless of the encapsulation methodology employed, the outer wall or shell material and solvents used to form the microcapsules of the invention can vary. Classes of materials that are typically used as wall or shell materials include proteins, polysaccharides, starches, waxes, fats, natural and synthetic polymers, and resins. Exemplary materials for use in the microencapsulation process used to form the microcapsules include gelatin, acacia (gum arabic), polyvinyl acetate, potassium alginate, carob bean gum, potassium citrate, carrageenan, potassium polymetaphosphate, citric acid, potassium tripolyphosphate, dextrin, polyvinyl alcohol, povidone, dimethylpolysiloxane, dimethyl silicone, refined paraffin wax, ethylcellulose, bleached shellac, modified food starch, sodium alginate, guar gum, sodium carboxymethylcellulose, hydroxypropyl cellulose, sodium citrate, hydroxypropylmethylcellulose, sodium ferrocyanide, sodium polyphosphates, locust bean gum, methylcellulose, sodium trimetaphosphate, methyl ethyl cellulose, sodium tripolyphosphate, microcrystalline wax, tannic acid, petroleum wax, terpene resin, tragacanth, polyethylene, xanthan gum, and polyethylene glycol.

Microcapsules are commercially available, and exemplary types of microcapsule technologies are of the type set forth in Gutcho, Microcapsules and Microencapsulation Techniques (1976); Gutcho, Microcapsules and Other Capsules Advances Since 1975 (1979); Kondo, Microcapsule Processing and Technology (1979); Iwamoto et al., AAPS Pharm. Sci. Tech. 2002 3(3): article 25; U.S. Pat. No. 3,550,598 to McGlumphy; U.S. Pat. No. 4,889,144 to Tateno et al.; U.S. Pat. No. 5,004,595 to Cherukuri et al.; U.S. Pat. No. 5,690,990 to Bonner; U.S. Pat. No. 5,759,599 to Wampler et al.; U.S. Pat. No. 6,039,901 to Soper et al.; U.S. Pat. No. 6,045,835 to Soper et al.; U.S. Pat. No. 6,056,992 to Lew; U.S. Pat. No. 6,106,875 to Soper et al.; U.S. Pat. No. 6,117,455 to Takada et al.; U.S. Pat. No. 6,325,859 to DeRoos et al.; U.S. Pat. No. 6,482,433 to DeRoos et al.; U.S. Pat. No. 6,612,429 to Dennen; and U.S. Pat. No. 6,929,814 to Bouwmeesters et al.; U.S. Pat. Appl. Pub. Nos. 2006/0174901 to Karles et al. and 2007/0095357 to Besso et al.; and PCT WO2007/037962 to Holton et al.; each of which is incorporated herein by reference. Suitable types of microcapsules are available from sources such as Microtek Laboratories of Dayton, Ohio. Exemplary types of commercially available microencapsulating techniques include those marketed under the trade names ULTRASEAL™ and PERMASEAL™ available from Givaudan headquartered in Vernier, Switzerland.

As shown in FIGS. 2-4, embodiments of the smokeless tobacco product may include larger capsules containing any of the additives described herein for use in microcapsules. Exemplary smaller spherical capsules have diameters of at least about 0.5 mm, generally at least about 1 mm, often at least about 2 mm, and frequently at least about 3 mm. Exemplary larger spherical capsules have diameters of less than about 6 mm, and often less than about 5 mm. Exemplary smaller individual capsules weigh at least about 5 mg, often at least about 15 mg, and frequently at least about 25 mg. Exemplary larger individual capsules weigh less than about 75 mg, generally less than about 65 mg, and often less than about 55 mg.

Representative types of capsules are of the type commercially available as "Momints" by Yosha! Enterprises, Inc. and "Ice Breakers Liquid Ice" from The Hershey Company. Representative types of capsules also have been incorporated in chewing gum, such as the type of gum marketed under the tradename "Cinnaburst" by Cadbury Adams USA. Representative types of capsules and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. U.S. Pat. No. 6,631,722 to MacAdam et al.; and U.S. Pat. No. 7,115,085 to Deal; US Pat. Pub. Nos. 2004/0261807 to Dube et al.; 2006/0272663 to Dube et al.; 2006/01330961 to Luan et al.; 2006/0144412 to Mishra et al.; 2007/0012327 to Karles et al.; and 2007/0068540 to Thomas et al.; PCT WO 03/009711 to Kim; PCT WO2006/136197 to Hartmann et al.; PCT WO 2006/136199 to Mane et al., PCT WO 2007/010407; and PCT WO 2007/060543, as well as within filtered cigarettes that have been marketed under the tradename "Camel Lights with Menthol Boost" by R. J. Reynolds Tobacco Company, which are incorporated herein by reference. See also, the types of capsules and components thereof set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al. and U.S. Pat. No. 6,949,256 to Fonkwe et al.; and U.S. Pat. App. Pub. Nos. 2004/0224020 to Schoenhard; 2005/0123601 to Mane et al.; 2005/0196437 to Bednarz et al.; and 2005/0249676 to Scott et al.; which are incorporated herein by reference. The capsules may be colored, provided with smooth or rough surfaces, have rigid or pliant shells, have brittle or durable shells, or other desired features or characters.

The smokeless tobacco product can include other flavorants in the form of beads, pellets, rods, strands, sheets, strips, or other shaped items designed to deliver a pre-determined, concentrated amount of a flavoring ingredient to the user. Such forms typically include a carrier material (i.e., a matrix material) and a flavorant dispersed therein, and allow for controlled delivery of the flavorant. For example, representative types of materials and ingredients useful for the manufacture of essentially water insoluble flavored beads, strands or pellets may be found within the filters of cigarettes available as Camel Dark Mint, Camel Mandarin Mint, Camel Spice Crema, Camel Izmir Stinger, Camel Spice Twist, Camel Mandalay Lime and Camel Aegean Spice by R. J. Reynolds Tobacco Company. For example, at least one flavored strip, piece or sheet of flavored water dispersible or water soluble material (e.g., a breath-freshening edible film type of material) may be disposed within each pouch as shown in FIG. 3. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

Although less preferred, at least one larger capsule may be enclosed within a small moisture permeable mesh pouch that is in turn contained within the outer mesh container of the smokeless tobacco product. In such an embodiment, the tobacco formulation within the pouch may be segregated from at least one of the capsules also contained within that pouch, as shown in FIG. 4.

Tobaccos used for the manufacture of tobacco products pursuant to the present invention may vary. The tobaccos may include types of tobaccos such as flue-cured tobacco, burley tobacco, Oriental tobacco, Maryland tobacco, dark tobacco, dark-fired tobacco, dark air cured (e.g., passanda, cubano, jatin and bezuki tobaccos) or light air cured (e.g., North Wisconsin and galpoa tobaccos), and Rustica tobaccos, as well as other rare or specialty tobaccos. Descriptions of various types of tobaccos, growing practices, harvesting practices and curing practices are set forth in *Tobacco Production, Chemistry and Technology*, Davis et al. (Eds.) (1999), which is incorporated herein by reference. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in U.S. patent application Ser. No. 11/696,416 to Marshall et al., filed Apr. 4, 2007, which is incorporated herein by reference.

Tobacco products of the present invention, such as the embodiments illustrated in FIGS. 1-4, may incorporate a single type of tobacco (e.g., in a so-called "straight grade" form). For example, the tobacco within a tobacco product may be composed solely of flue-cured tobacco (e.g., all of the tobacco may be composed, or derived from, either flue-cured tobacco lamina or a mixture of flue-cured tobacco lamina and flue-cured tobacco stem). The tobacco within a tobacco product also may have a so-called "blended" form. For example, the tobacco within a tobacco product of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis.

The tobacco material can have the form of processed tobacco parts or pieces, cured and aged tobacco in essentially natural lamina or stem form, a tobacco extract, extracted tobacco pulp (e.g., using water as a solvent), or a mixture of the foregoing (e.g., a mixture that combines extracted tobacco pulp with granulated cured and aged natural tobacco lamina).

The tobacco that is used for the tobacco product most preferably includes tobacco lamina, or tobacco lamina and stem mixture. Tobacco mixtures incorporating a predominant amount of tobacco lamina, relative to tobacco stem, are preferred. Most preferably, the tobacco lamina and stem are used in an unextracted form, that is, such that the extractable portion (e.g., the water soluble portion) is present within the unextractable portion (e.g., the tobacco pulp) in a manner comparable to that of natural tobacco provided in a cured and aged form. Most preferably, the tobacco is not provided in a reconstituted form, extruded form, or any form that has resulted from extraction and recombination of components of that tobacco. However, portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). In addition, the tobacco product optionally may incorporate tobacco that has been fermented. See, also, the types of tobacco processing techniques set forth in PCT WO 05/063060 to Atchley et al., which is incorporated herein by reference.

If desired, the tobacco material may be cased and dried, and then ground to the desired form. For example, the tobacco material may be cased with an aqueous casing containing components such as sugars (e.g., fructose, glucose, and sucrose), humectants (e.g., glycerin and propylene glycol), flavoring ingredients (e.g., cocoa and licorice), and the like. Non-aqueous casing components preferably are applied to the tobacco in amounts of about 1 percent to about 15 percent, based on the dry weight of the tobacco.

The tobacco used for the manufacture of the tobacco product preferably is provided in a shredded, ground, granulated, fine particulate, or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. In one embodiment, the tobacco material is in particulate form sized to pass through an 18 Tyler mesh, but not through a 60 Tyler mesh. If desired, differently sized pieces of granulated tobacco may be mixed together. Typically, the very finely divided tobacco particles or pieces suitable for snus products have a particle size greater than −8 Tyler mesh, often −8 to +100 Tyler mesh, frequently −18 to +60 Tyler mesh.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent.

The relative amount of tobacco within the tobacco formulation may vary. Preferably, the amount of tobacco within the tobacco formulation is at least about 25 percent or at least about 30 percent, on a dry weight basis of the formulation. In certain instances, the amounts of other components within the tobacco formulation may exceed about 40 percent, on a dry weight basis. A typical range of tobacco material within the formulation is about 30 to about 40 weight percent.

The moisture content of the tobacco formulation prior to use by a consumer of the formulation may vary. Typically, the moisture content of the tobacco formulation, as present within the pouch prior to insertion into the mouth of the user, is less than about 55 weight percent, generally is less than about 50 weight percent, and often is less than about 45 weight percent. Certain types of tobacco formulations have moisture contents, prior to use, of less than about 15 weight percent, frequently less than about 10 weight percent, and often less than about 5 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 25 weight percent to about 50 weight percent, preferably about 30 weight percent to about 40 weight percent.

The manner by which the moisture content of the formulation is controlled may vary. For example the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders or drums, liquid spray apparatus, ribbon blenders, mixers available as FKM130, FKM600, FKM1200, FKM2000 and FKM3000 from Littleford Day, Inc., Plough Share types of mixer cylinders, and the like. Most preferably, moist tobacco formulations, such as the types of tobacco formulations employed within snus types of products, are subjected to pasteurization or fermentation. Techniques for pasteurizing or fermenting snus types of tobacco products will be apparent to those skilled in the art of snus product design and manufacture.

The acidity or alkalinity of the tobacco formulation, which is often characterized in terms of pH, can vary. Typically, the pH of that formulation is at least about 6.5, and preferably at least about 7.5. Typically, the pH of that formulation will not exceed about 9, and often will not exceed about 8.5. A representative tobacco formulation exhibits a pH of about 6.8 to about 8.2. A representative technique for determining the pH of a tobacco formulation involves dispersing 5 g of that formulation in 100 ml of high performance liquid chromatography water, and measuring the pH of the resulting suspension/solution (e.g., with a pH meter).

As noted above, prior to preparation of the tobacco formulation, the tobacco parts or pieces may be irradiated, or those parts and pieces may be pasteurized, or otherwise subjected to controlled heat treatment. Additionally, if desired, after preparation of all or a portion of the formulation, the component materials may be irradiated, or those component materials may be pasteurized, or otherwise subjected to controlled heat treatment. For example, a formulation may be prepared, followed by irradiation or pasteurization, and then flavoring ingredient(s) may be applied to the formulation. Alternatively, the tobacco formulation can be irradiated or pasteurized after the tobacco formulation has been incorporated within a moisture-permeable packet or pouch (e.g., so as to provide individual containers of snus-type smokeless tobacco product.

In one aspect, the present invention relates to a tobacco treatment process. The process involves heat treatment of tobacco used in the preparation of a tobacco formulation suitable for use as a smokeless tobacco formulation. The process involves subjecting tobacco material, which most preferably is in moist form, to heat treatment. The heat treatment can be carried out in an enclosed vessel (e.g., one providing for a controlled atmospheric environment, controlled atmospheric components, and a controlled atmospheric pressure), or in a vessel that is essentially open to ambient air. The heat treatment, which is provided by subjecting the tobacco material to a sufficiently high temperature for a sufficient length of time, has the ability to alter the overall character or nature of the tobacco material to a desired degree. For example, the heat treatment can be used to provide a desired color or visual character to the tobacco material, desired sensory properties to the tobacco material, or a desired physical nature or texture to the tobacco material. In addition, the heat treatment causes the tobacco material to experience a treatment characteristic of a pasteurization type of treatment. As such, certain types and amounts of spores, mold, microbes, bacteria, and the like can be rendered inactive, or the enzymes generated thereby can be denatured or otherwise rendered inactive. Certain components that are rendered inactive, or are otherwise effectively reduced in number, are biological agents (e.g., enzymes) that have the capability of promoting formation of tobacco-specific nitrosamines. Pasteurization techniques are set forth, for example, on the websites of the U.S. Food and Drug Administration and the U.S. Department of Agriculture.

The temperature and time of the heat treatment process will vary, and generally, the length of the heat treatment will decrease as the temperature of the heat treatment increases. It is preferably to avoid excessively high heat treatment temperatures, such as temperatures at or above the boiling point of water. However, the temperature of the heat treatment step can be characterized as elevated, meaning the temperature is greater than room temperature (i.e., greater than 25° C.). The methods and equipment used to accomplish the heat treatment can vary. The temperature can be controlled by using a jacketed vessel, direct steam injection into the tobacco, bubbling hot air through the tobacco, and the like. The processes of the invention set forth below can be performed using equipment known in the art such as various mixing apparatus, including various jacketed mixing apparatus capable of heating the contents of the mixer, as well as stirring or agitating the contents of the mixer. Various types of pressure-controlled or vented mixing vessels can be used. Exemplary mixing vessels include mixers available from Scott Equipment Company, Littleford Day, Inc., Lödige Process Technology, and the Breddo Likwifier Division of American Ingredients Company. Examples of vessels which provide a pressure controlled environment include high pressure autoclaves available from Berghof/America Inc. of Concord, Calif., and high pressure reactors available from The Parr Instrument Co. (e.g., Parr Reactor Model Nos. 4522 and 4552 described in U.S. Pat. No. 4,882,128 to Hukvari et al.). Preferred mixers allow for direct steam injection into the contents of the mixer. All process steps noted below can be conducted while the tobacco material is being stirred or agitated. The pressure within the mixing vessel during the process can be atmospheric pressure or elevated pressure (e.g., about 10 psig to about 1,000 psig).

Preferably, the moisture content of the moist tobacco material subjected to heat treatment is at least about 30 percent, often is at least about 35 percent, and frequently is at least about 40 percent, based on the total weight of the tobacco formulation being subjected to heat treatment. The tobacco material can be moisturized by addition of aqueous fluids, such as steam, liquid tap water, aqueous solutions of sodium chloride, and the like. Upon completion of at least some degree of the heat treatment step, the moist tobacco material is contacted with a basic material (e.g., sodium carbonate, sodium bicarbonate, or a mixture thereof) in order to raise the pH to the alkaline pH range. When contacted with the basic material, the moisture content of the tobacco material is at least about 30 percent, often is at least about 35 percent, and frequently is at least about 40 percent, based on the total weight of the tobacco formulation. Preferably, the tobacco material is cooled somewhat prior to addition of the basic material thereto (e.g., the tobacco can be cooled to below about 75° C., frequently below about 65° C., and often below about 55° C.). The tobacco mixture is allowed to interact with the basic material while that tobacco material experiences a sufficiently high moisture level until the pH of the tobacco material drops to about 8 pH units. Then, the tobacco material is cooled and dried.

During heat treatment, various flavorant materials can be added to the tobacco material as desired. Exemplary flavorant compositions include various top dressing and casing compositions, including those compositions described in U.S. Pat. Nos. 5,121,757 to White et al.; U.S. Pat. No. 5,370,139 to Shu et al.; U.S. Pat. No. 5,318,050 to Gonzalez-Parra et al.; U.S. Pat. No. 5,343,879 to Teague; U.S. Pat. No. 5,413,122 to Shu et al.; U.S. Pat. No. 5,962,662 to Shu et al.; U.S. Pat. No. 6,048,404 to White; U.S. Pat. No. 6,298,858 to Coleman, III, et al.; U.S. Pat. No. 6,325,860 to Coleman, III; U.S. Pat. No. 6,428,624 to Coleman, III, et al.; U.S. Pat. No. 6,591,841 to White et al.; and U.S. Pat. No. 6,695,924 to Dube et al.; and US Pat. App. Pub. No. 2004/0173228 to Coleman, III, all of which are incorporated by reference herein. Additionally, during the heat treatment processes described herein, various other additives can be introduced to the tobacco composition, such as ammonia, ethylene oxide, sulfur dioxide, and chlorine dioxide. Additional types of additives or reagents that can be introduced into tobacco materials are set forth in US Pat. App. Pub. No. 2004/0250821 to Perfetti, et al., which is incorporated by reference herein.

Thus, the invention provides various processes for preparing a tobacco material for use in a smokeless tobacco product. In particular, the methods of the invention involve heat treatment of the tobacco and adjustment of the pH of the tobacco in a manner adapted for improving the storage stability of the sensory characteristics of the smokeless tobacco product. In one process of the invention, a tobacco material in a desired form (e.g., shredded or particulate form) is provided. The tobacco material may comprise a blend of various tobacco types, such as a blend of various tobacco lamina materials (e.g., flue-cured lamina, Oriental lamina, and the like) and various stem materials (e.g., Rustica stem, Kurnool stem, Indian Sun-Cured stem, and the like). The blend of tobacco materials is typically provided at a low moisture level, such as about 5 to about 15% by weight (e.g., about 10-12% by weight) based on the total weight of the tobacco material.

The tobacco material is preferably combined with a salt material, and the salt material is preferably in aqueous solution form. In one embodiment, an aqueous sodium chloride solution is added to the tobacco material and the resulting mixture typically has a moisture content of about 30 to about 50% by weight, often about 30 to about 40% by weight (e.g., 35% by weight). If desired, the tobacco material can be heated while the sodium chloride or other salt material is added in order to aid thorough mixing of the salt solution with the tobacco material. For example, the heating can comprise heating the tobacco material to a temperature of at least about 60° C., typically about 60° C. to about 65° C.

The moist tobacco material with optional salt component is then subjected to a heat treatment step, which involves heating the tobacco material for a time and at a temperature sufficient to pasteurize the tobacco as described above. Exemplary heating temperatures include temperatures of about 85° C. or higher, such as about 85° C. to about 100° C., more typically about 90° C. to about 95° C. The time of exposure to the pasteurization temperature can vary, but is typically at least about 1 hour, such as about 1 hour to about 3 hours. In one embodiment, the heating of the tobacco is conducted by both raising the jacket temperature of the mixer holding the tobacco material and direct steam injection into the tobacco material. The steam injection will also typically result in an increase in moisture content of the tobacco during the heating step. Typically, the moisture content of the tobacco material is maintained during the heating step at essentially a constant moisture level or is allowed to rise slightly, such as a level of at least about 30% by weight, such as about 30% to about 40% by weight (e.g., about 35% by weight). In other words, the tobacco is maintained in a relatively moist condition during the heating step.

Following the heat treatment step, the tobacco material is typically cooled prior to addition of a base intended to raise the pH of the material. The temperature of the tobacco material is typically reduced to about 60° C. to about 65° C. A base is then added to the tobacco material and thoroughly mixed with the tobacco material. The base can be any material capable of raising the pH of the tobacco material to an alkaline pH range (e.g., about 9 to about 10). Exemplary bases include alkali metal hydroxides, alkali metal carbonates, alkali metal bicarbonates, and mixtures thereof. Specific base materials that can be used include sodium carbonate, potassium carbonate, sodium bicarbonate, potassium bicarbonate, sodium hydroxide, potassium hydroxide, and mixtures thereof.

The base is typically added in the form of an aqueous solution and the base addition step typically results in an increase of moisture content of the tobacco material. In one embodiment, sufficient base is added to the tobacco material to result in a tobacco material pH of at least about 8.7, such as a pH of about 8.7 to about 10. The final moisture content is often about 40% to about 55% by weight, frequently about 45% to about 50% by weight.

Following addition of the base and water, the resulting moist, pH-adjusted tobacco material is heated at an elevated temperature, such as a temperature of at least about 55° C., often at a temperature range of about 55° C. to about 95° C., more often about 65° C. to about 75° C. During this heating step, the moisture level of the tobacco material is held relatively constant or allowed to rise slightly in order to promote the continued reaction between the tobacco material and the base. The moisture level of the tobacco material is preferably maintained at a level of at least about 40% by weight, and typically about 40% to about 55% by weight, frequently about 45% to about 50% by weight. In order to prevent significant loss of moisture during this step, the mixing vessel containing the tobacco material is typically not vented to atmosphere, although a small flow of filtered air can be allowed to pass through the head space of the mixer to remove ammonia that forms as the base reacts with acidic materials in the tobacco material.

The heating step following base addition will typically continue for at least about 1 hour, and often will continue for about 1 to about 3 hours. During this step, it is preferable to allow the pH to drop to below about 8.5, such as about 8.0 to about 8.5 (e.g., about 8.1, about 8.2, about 8.3, about 8.4, or about 8.5). Typically, by monitoring and controlling the moisture and temperature level of the tobacco during this heating step, it is possible to maintain an advantageous rate of pH reduction as the base continues to react with acidic materials in the moist tobacco. In one embodiment, the rate of pH reduction is maintained at about 0.05 to about 0.15 pH units per hour, more typically about 0.08 to about 0.10 pH units per hour (e.g., about 0.09 pH units per hour).

Following the above heating step, the moist tobacco material is dried by continued heating of the tobacco material while the mixing vessel is allowed to vent such that water vapor is removed. This step typically involves heating the tobacco material at a moderate elevated temperature, such as at a temperature of at least about 35° C., frequently at a temperature of about 35° C. to about 70° C., more often about 55° C. to about 65° C. The length of the drying step can vary, but is typically about 20 to about 24 hours. The final moisture content of the tobacco material following drying is often less than about 35% by weight, such as about 25% to about 35% by weight, frequently about 25% to about 30% by weight. It is advantageous to maintain the pH of the material during the drying step in the range of about 7.6 to about 8.2.

In an alternative process, the tobacco material is initially mixed with a large excess of water to form a mixture having a relatively high moisture content, which can be characterized as a slurry, prior to heat treatment. The slurry typically comprises at least about 75% by weight of water, and often at least about 80% by weight of water. In one embodiment, the tobacco material slurry comprises about 75% to about 95% by weight water. Optionally, the slurry is mixed with a salt material, such as an aqueous solution of sodium chloride. The salt material is typically added in amount of about 1 to about 8% by weight (e.g., about 1 to about 3% by weight) of the tobacco material, based on the dry weight of the tobacco material.

Following the optional addition of a salt material, the slurry is heated in order to pasteurize the tobacco material. The heating step typically comprises heating the tobacco material slurry to a temperature of at least about 60° C., such as a temperature of about 60° C. to about 100° C., more often about 70° C. to about 90° C. (e.g., about 75° C.). The time of heating can vary, but will typically be at least about 30 minutes, such as about 30 minutes to about 1 hour.

Following the heating step, and typically while the slurry is still at elevated temperature, a base material is added. As noted above, the base material is typically in the form of an aqueous solution and the base can be any basic material such as those materials set forth above. In one embodiment, the base is added in an amount of about 3 to about 11% by weight based on the dry weight of the tobacco material. Sufficient base is added to raise the pH of the slurry to an alkaline pH range, such as at least about 8.5, and typically at least about 9.0. An exemplary pH range for the slurry following base addition is about 8.5 to about 11, more frequently about 9 to about 10. Following base addition, the slurry is agitated and heated to an elevated temperature, such as a temperature of at least about 60° C., for a period of time sufficient to allow the pH of the slurry to drop at least about 0.5 pH units. The time of heating will typically be at least about 1.5 hours, such as a range of about 1.5 hours to about 3.0 hours. The temperature of the heating step will typically range from about 70° C. to about 95° C. The final pH of the slurry following this heating step will typically be in the range of about 8.0 to about 8.5 (e.g., about 8.1, about 8.2, about 8.3, about 8.4, or about 8.5). Although not bound by any particular theory of operation, it is believed that adjusting the pH of the tobacco material while in aqueous slurry form results in greater interaction between acidic materials within the tobacco and the added base, which in turn increases the storage stability of the pH of the final smokeless tobacco product.

Thereafter, the slurry can be cooled to ambient temperature, such as a temperature below about 35° C. If desired, during or after cooling, a humectant such as glycerol, propylene glycol, or sugar alcohol (e.g., maltitol syrup) can be added. The tobacco material is then dried. In one embodiment, the drying step involved casting the slurry onto a belt (e.g., a stainless steel belt) and passing the tobacco through a drying zone operated at a temperature of about 85° C. to about 285° C. The typical resident time of the tobacco material in the drying zone is about 2 to about 5 minutes. Alternatively, the belt speed through the drying zone or tunnel can range from about 25 to about 55 feet/min. The final moisture content of the dried tobacco material is typically about 5 to about 15% by weight, often about 10 to about 12% by weight. Tobacco material drying techniques are set forth, for example, in U.S. Pat. No. 4,941,484 to Clapp et al.; U.S. Pat. No. 5,005,593 to Fagg et al.; and U.S. Pat. No. 5,234,008 to Fagg, which are incorporated by reference herein.

In another example of a heat treatment process involving a tobacco mixture having a high moisture content, a smokeless tobacco formulation is prepared using tobacco treated in a similar manner to that for a paper process reconstituted tobacco, such as described in U.S. Pat. Nos. 5,159,942 and 5,445,169 to Brinkley. In this process, tobacco is subjected to an aqueous extraction at an elevated temperature in order to separate the tobacco material into a solids portion and an extract portion, wherein the extract portion typically has a relatively low solids content (e.g., about 3-6% solids). The time and temperature of the extraction can vary, but typically the temperature is at least about 60° C., such as a temperature of about 60° C. to about 100° C., more often about 70° C. to about 90° C. (e.g., about 75° C.), and the time is typically about 30 minutes to about 1.5 hours. The aqueous solution used to extract the tobacco material typically contains a salt and a base material, such as about 3 to about 8% by weight of a salt (e.g., sodium chloride) and about 1 to about 5% by weight of a base (e.g., sodium hydroxide), based on the weight of the tobacco. The extract is then preferably cooled down (e.g., cooled to about 65° C.) and optionally neutralized by addition of a base (e.g., about 3.5% sodium hydroxide and about 3.5% potassium carbonate by weight of tobacco). Following the neutralization step, the pH of the extract can changes from about 9.0-9.5 to about 8.0-8.5. Thereafter, the extract can be concentrated to form a concentrated extract with a relatively high solids content, such as about 30-35% solids, via vacuum evaporation, for example. After evaporation, the concentrated extract is optionally mixed with a humectant (e.g., about 6% glycerin), and then added back to the extracted solids portion. The resulting tobacco material can be dried to reduce the moisture content, such as to about 10 to about 12% moisture. The drying step can be accomplished, for example, using a forced air oven at a temperature of about 85° C. to about 100° C.

Using any of the above-noted heat treatment processes, the tobacco material is allowed to intimately mix with the base material in a moist environment for a time sufficient to encourage significant interaction between the base and acidic species within the tobacco. Significant drying of the tobacco is prevented until sufficient contact between the tobacco and base has occurred. As a result, it is believed that the above processes lead to greater storage stability of the sensory characteristics of the smokeless tobacco products formed using the tobacco materials treated according to these processes, and in particular, it is believed that greater pH storage stability of the final product can be achieved using the processes of the invention.

Following any of the above-described processes, the resulting tobacco material can be mixed with additional flavorants, including sweeteners. Various flavorants and water can be added as necessary to adjust flavor and moisture content such that the tobacco material exhibits the desired final moisture range for the product, which can vary as noted above. In one embodiment, the moisture content of the tobacco composition is raised to at least about 25% by weight in this step.

If desired, all or a portion of the tobacco material used in the smokeless tobacco products of the invention can be toasted in order to favorably alter the sensory characteristics of the resulting product. A typical toasting process, which can occur either before or after the above-described heat treatment processes, comprises heating a relatively dry tobacco material (e.g., having a moisture content of about 5% to about 20% by weight) at an elevated temperature (about 85° C. to about 300° C.) for a time sufficient to toast the tobacco material, such as a period of about 1 to about 3 hours. The tobacco can be mixed with a base and/or sugars (e.g., glucose, fructose, sucrose, high fructose corn syrup, caramel, rhamnose, or mixtures thereof), or sugar alcohols (e.g., maltitol, mannitol, xylitol, sorbitol, or mixtures thereof), prior to heating in order to promote Maillard reactions during heating. Exemplary toasting conditions are set forth, for example, in U.S. Pat. Nos. 4,534,372 to White and U.S. Pat. No. 4,596,259 to White et al., which are incorporated by reference herein.

The tobacco used for the manufacture of the tobacco product also can be processed, blended, formulated, combined and mixed with other materials or ingredients, including non-encapsulated amounts of any of the additives that can be used in the microcapsules discussed herein. For example, the tobacco composition can incorporate salts, sweeteners, binders, colorants, pH adjusters, fillers, oral care additives, flavoring agents, disintegration aids, antioxidants, humectants, and preservatives. See, for example, those representative components, combination of components, relative amounts of those components and ingredients relative to tobacco, and manners and methods for employing those components, set forth in U.S. patent application Ser. No. 11/233,399 to Holton, et al. and U.S. patent application Ser. No. 11/351,919 to Holton, et al., each of which is incorporated herein by reference.

The relative amounts of the various components within the tobacco formulation, including the amount of the additive within the core region of the microcapsules, may vary. The amounts presented herein are total amounts of each type of additive, and can represent both encapsulated (or otherwise separated forms) and non-encapsulated components. In other words, the smokeless tobacco products of the invention can include any of the various amounts of additive solely in the form of a microencapsulated or otherwise separated additive, solely in the form of a non-encapsulated additive, or in the form of a mixture of encapsulated and non-encapsulated additive.

A sweetener is most preferably employed in amounts sufficient to provide desired flavor attributes to the tobacco formulation. When present, a representative amount of sweetener, whether an artificial sweetener and/or natural sugar, may make up at least about 1 percent to at least about 3 percent, of the total dry weight of the formulation. Preferably, the amount of sweetener within the formulation will not exceed about 40 percent, often will not exceed about 35 percent, and frequently will not exceed about 30 percent, of the total dry weight of the formulation.

A tobacco-containing microencapsulated (or otherwise separated) additive, such as particulate tobacco or a tobacco extract, is preferably present in an amount sufficient to provide desired flavor attributes to the tobacco formulation. The tobacco-containing microencapsulated additive is often present in an amount of at least about 5 percent of the total dry weight of the formulation, more typically at least about 10 percent. The amount of tobacco-containing microencapsulated additive is typically less than about 50 weight percent, often less than about 40 weight percent, and frequently less than about 30 weight percent of the total dry weight of the formulation.

Embodiments of the invention including microencapsulated (or otherwise separated) water typically include an amount of water in microencapsulated form of at least about 10 percent, typically at least about 15 percent, and frequently at least about 20 percent, based on the total weight of the formulation. The amount of microencapsulated water is typically less than about 35 percent, often less than about 30 percent, and frequently less than about 25 percent.

An additive derived from an herbal or botanical source is preferably employed in amounts sufficient to provide desired functional attributes to the tobacco formulation and the amount will vary depending on the desired function and the type of herbal or botanical source. When present, a representative amount of additive is at least about 1 percent to at least about 3 percent, of the total dry weight of the formulation. Preferably, the amount of additive within the formulation will not exceed about 40 percent, often will not exceed about 35 percent, and frequently will not exceed about 30 percent, of the total dry weight of the formulation.

A binder may be employed in amounts sufficient to provide the desired physical attributes and physical integrity to the tobacco formulation. When present, a representative amount of binder may make up at least about 1 percent to at least about 3 percent of the total dry weight of the formulation. Preferably, the amount of binder within the formulation will not exceed about 20 percent of the total dry weight of the formulation. Often, the amount of binder within a desirable formulation will not exceed about 15 percent, and frequently will not exceed about 10 percent, of the total dry weight of the formulation.

A disintegration aid may be employed in an amount sufficient to provide control of desired physical attributes of the tobacco formulation such as, for example, by providing loss of physical integrity and dispersion of the various component materials upon contact of the formulation with water (e.g., by undergoing swelling upon contact with water). When present, a representative amount of disintegration aid may make up at least about 1 percent to at least about 10 percent of the total dry weight of the formulation. Preferably, the amount of disintegration aid within the formulation will not exceed about 50 percent, and frequently will not exceed about 30 percent, of the total dry weight of the formulation.

A colorant may be employed in amounts sufficient to provide the desired visual attributes to the tobacco formulation. When present, a representative amount of colorant may make up at least about 1 percent to at least about 3 percent, of the total dry weight of the formulation. Preferably, the amount of colorant within the formulation will not exceed about 30 percent, and frequently will not exceed about 10 percent, of the total dry weight of the formulation.

A filler preferably is employed in amounts sufficient to provide control of desired physical attributes and sensory attributes to the tobacco formulation. When present, a representative amount of filler, whether an organic and/or inorganic filler, may make up at least about 5 percent to at least about 15 percent, of the total dry weight of the formulation. Preferably, the amount of filler within the formulation will not exceed about 60 percent, and frequently will not exceed about 40 percent, of the total dry weight of the formulation.

A buffering or pH adjusting agent may be employed in the tobacco formulation. When present, a representative amount of buffering or pH adjusting agent may make up at least about 1 percent to at least about 3 percent of the total dry weight of the formulation. Preferably, the amount of buffering or pH adjusting agent within the formulation will not exceed about 10 percent, and frequently will not exceed about 5 percent, of the total dry weight of the formulation.

A non-sweetener flavorant preferably is employed in amounts sufficient to provide desired sensory attributes to the tobacco formulation. When present, a representative amount of flavorant (e.g., vanillin) may make up at least about 1 percent to at least about 3 percent of the total dry weight of the formulation. Preferably, the amount of flavoring ingredient will not exceed about 15 percent, and frequently will not exceed about 5 percent, of the total dry weight of the formulation.

A salt may be employed in amounts sufficient to provide desired sensory attributes to the tobacco formulation. When present, a representative amount of salt may make up at least about 1 percent to at least about 3 percent of the total dry weight of the formulation. Preferably, the amount of salt within the formulation will not exceed about 10 percent, and frequently does not exceed about 5 percent, of the total dry weight of the formulation.

An antioxidant may be employed in the tobacco formulation. When present, a representative amount of antioxidant may make up at least about 1 percent to at least about 3 percent, of the total dry weight of the formulation. Preferably, the amount of antioxidant within the formulation will not exceed about 25 percent, and frequently will not exceed about 10 percent, of the total dry weight of the formulation.

A preservative may be employed in the tobacco formulation. When present, a representative amount of preservative may make up at least about 0.1 percent to at least about 1 percent, of the total dry weight of the formulation. The amount of preservative within the formulation will not typically exceed about 5 percent, and frequently will not exceed about 3 percent, of the total dry weight of the formulation.

The tobacco formulation can incorporate at least one oral care ingredient (or mixture of such ingredients) that provides the ability to inhibit tooth decay or loss, inhibit gum disease, relieve mouth pain, whiten teeth or otherwise inhibit tooth staining, elicit salivary stimulation, inhibit breath malodor, freshen breath, or the like. For example, effective amounts of ingredients such as thyme oil, eucalyptus oil and zinc (e.g., such as the ingredients of formulations commercially available as ZYTEX® from Discus Dental) can be incorporated into the formulation. Other exemplary ingredients that can be incorporated in desired effective amounts within tobacco-containing formulations can include those that are incorporated within the types of oral care compositions set forth in Takahashi et al., Oral Microbiology and Immunology, 19(1), 61-64 (2004); U.S. Pat. No. 6,083,527 to Thistle; and US Pat. Appl. Pub. Nos. 2006/0210488 to Jakubowski and 2006/02228308 to Cummins et al. Other exemplary ingredients of tobacco containing-formulation include those contained in formulations marketed as MALTISORB® by Roquette and DENTIZYME® by NatraRx. When present, a representative amount of oral care additive is at least about 1 percent, often at least about 3 percent, and frequently at least about 5 percent of the total dry weight of the formulation. The amount of oral care additive within the formulation will not typically exceed about 30 percent, often will not exceed about 25 percent, and frequently will not exceed about 20 percent, of the total dry weight of the formulation.

Representative tobacco formulations may incorporate about 25 to about 60 percent tobacco, about 1 to about 5 percent artificial sweetener, about 1 to about 5 percent colorant, about 10 to about 60 percent organic and/or inorganic filler, about 5 to about 20 percent disintegrating aid, about 1 to about 5 percent binder, about 1 to about 5 percent pH-adjusting/buffering agent, flavoring ingredient in an amount of up to about 10 percent, preservative in an amount up to about 2 percent, and salt in an amount up to about 5 percent, based on the total dry weight of the tobacco formulation. The particular percentages and choice of ingredients will vary depending upon the desired flavor, texture, and other characteristics.

The manner by which the various components of the tobacco formulation are combined may vary. The various components of the formulation may be contacted, combined, or mixed together in conical-type blenders, mixing drums, ribbon blenders, or the like. As such, the overall mixture of various components with the powdered tobacco components may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

Although the tobacco composition most preferably is provided in a form that is characteristic of a snus type of product as described with reference to the accompanying drawings, the tobacco composition also can have the form of loose moist snuff, loose dry snuff, chewing tobacco, pelletized tobacco pieces, extruded tobacco strips or pieces, finely divided ground powders, finely divided or milled agglomerates of powdered pieces and components, flake-like pieces (e.g., that can be formed by agglomerating tobacco formulation components in a fluidized bed), molded processed tobacco pieces (e.g., formed in the general shape of a coin, cylinder, bean, cube, or the like), pieces of tobacco-containing gum, products incorporating mixtures of edible material combined with tobacco pieces and/or tobacco extract, products incorporating tobacco (e.g., in the form of tobacco extract) carried by a solid inedible substrate, and the like. For example, the tobacco composition can have the form of compressed tobacco pellets, multi-layered extruded pieces, extruded or formed rods or sticks, compositions having one type of tobacco formulation surrounded by a different type of tobacco formulation, rolls of tape-like films, readily water-dissolvable or water-dispersible films or strips (see, for example, US Pat. Appl. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form).

Processed tobacco compositions, such as compressed tobacco pellets can be produced by compacting granulated tobacco and associated formulation components, compacting those components in the form of a pellet, and optionally coating each pellet with an overcoat material. Exemplary granulation devices are available as the FL-M Series granulator equipment (e.g., FL-M-3) from Vector Corporation and as WP 120V and WP 200VN from Alexanderwerk, Inc. Exemplary compaction devices, such as compaction presses, are available as Colton 2216 and Colton 2247 from Vector Corporation and as 1200i, 2200i, 3200, 2090, 3090 and 4090 from Fette Compacting. Devices for providing outer coating layers to compacted pelletized tobacco formulations are available as CompuLab 24, CompuLab 36, Accela-Cota 48 and Accela-Cota 60 from Thomas Engineering.

Processed tobacco compositions, such as multi-layered tobacco pellets, can be manufactured using a wide variety of extrusion techniques. For example, multi-layered tobacco pellets can be manufactured using co-extrusion techniques (e.g., using a twin screw extruder). In such a situation, successive wet or dry components or component mixtures can be placed within separate extrusion hoppers. Steam, gases (e.g., ammonia, air, carbon dioxide, and the like), and humectants (e.g., glycerin or propylene glycol) can be injected into the extruder barrel as each dry mix is propelled, plasticized, and cooked. As such, the various components are processed so as to be very well mixed, and hence, come in complete contact with each other. For example, the contact of components is such that individual components can be well embedded in the extrusion matrix or extrudate. See, for example, U.S. Pat. No. 4,821,749 to Toft et al., which is incorporated herein by reference. Multilayered materials can have the general form of films, and alternatively, multi-layered generally spherical materials can possess various layers extending from the inside outward.

Certain tobacco compositions can incorporate tobacco as the major component thereof. Preferably, those compositions do not, to any substantial degree, leave any residue in the mouth of the user thereof. Preferably, those compositions do not provide the user's mouth with slick or slimy sensation (e.g., due to overly high levels of binding agents). Tobacco materials, during processing, can be treated with pH adjusters or other suitable agents, so that natural pectins within the tobacco material can be released. Release of natural tobacco pectin can act to reduce the amount of additional gums/hydrocolloids, cellulose-derived, or starch-based binders needed to aid in desired sheet or film tensile strength qualities. For example, to release pectin, fine tobacco powder is cooked in an alkaline pH adjusted solution at elevated temperatures relative to ambient. Such treatment also can provide desirable sensory attributes to the tobacco material. See, for example, U.S. Pat. No. 5,099,864 to Young et al.; U.S. Pat. No. 5,339,838 to Young et al.; and U.S. Pat. No. 5,501,237 to Young et al., which are incorporated herein by reference.

One representative type of tobacco formulation possesses an outer shell and an inner region in the form of a tobacco formulation. A representative outer shell can be provided by providing a liquid mixture of alginates (e.g., sodium alginates available as Kelvis, Kelgin and Mannucol from International Specialty Products Corp.), rice starch, sucralose, glycerin and flavoring agent (e.g., mint flavor) in water so as to provide a liquid mix exhibiting a Brookfield viscosity at 25° C. of about 20,000 to about 25,000 centipoise. That viscous mixture can be used to form a sheet that can be formed into an outer layer (e.g., using a Villaware Imperia Pasta Machine, Dough Roller 150 equipped with a Villaware Ravioli Attachment for Imperia 150-25, each of which is available through Imperia Trading Company) or semi-circular shells that can be combined (e.g., by exposure to heat) to form an outer layer. Typically, such a viscous mixture can be suitably dried by heating at about 60° C. for about 1 hour. Inside that outer shell can be incorporated a wide variety of tobacco formulations. One representative tobacco formulation used as the inner region of such a is a dry or moist mixture of granulated or milled tobacco material that can be mixed with other ingredients, such as flavoring agents, humectants, fillers, pH adjusters, dispersion aids, and the like.

One representative tobacco formulation has the form of a gel or soft gel. That tobacco formulation can be provided by mixing granulated or milled tobacco material, kappa-carageenan, Kelvis-type sodium alginate, propylene glycol and flavoring agent (e.g., menthol and cinnamon) in water, such that the moisture content of the formulation is about 40 to about 50 weight percent.

One representative tobacco formulation has the form of a fluid. That tobacco formulation can be provided by mixing granulated or milled tobacco material, glycerin, propylene glycol, kappa-carageenan, carboxymethycellulose available as Ticalose 1500 from TIC Gums and micro-crystalline cellulose (e.g., Ticacel HV from TIC Gums) in water, such that the moisture content of the formulation is about 60 to about 70 weight percent.

In certain embodiments, particularly where the tobacco is in the form of a pellet or other processed form, it may be desirable to treat the tobacco material in the smokeless tobacco product with a bleaching or oxidizing agent in order to alter the color of the tobacco material. In some embodiments, it may be desirable to bleach the tobacco to a lighter color such that any residue remaining in the mouth of the user after use of the product is less visible and less likely to cause staining of fibrous materials, such as clothing, that may contact the residue. Exemplary bleaching agents include hydrogen peroxide, ozone, and ammonia. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 4,143,666 to Rainer; U.S. Pat. No. 4,194,514 to Campbell; U.S. Pat. No. 4,366,824 to Rainer et al.; U.S. Pat. No. 4,388,933 to Rainer et al.; and U.S. Pat. No. 4,641,667 to Schmekel et al.; and PCT WO 96/31255 to Giolvas, all of which are incorporated by reference herein.

The type of pouch used to contain the tobacco formulation can vary, and in fact, in certain embodiments, a pouch may be unnecessary. For example, tobacco formulations having the form of a tobacco pellet or other processed form already sized for individual use may not require containment in the form of a pouch. Instead, the pellets or other processed forms of the tobacco formulation could be simply packaged in an outer container without using a pouch to divide the tobacco formulation into individual serving sizes.

Suitable packets, pouches or containers of the type used for the manufacture of smokeless tobacco products are available under the tradenames "taboka," CatchDry, Ettan, General, Granit, Goteborgs Rape, Grovsnus White, Metropol Kaktus, Mocca Anis, Mocca Mint, Mocca Wintergreen, Kicks, Probe, Prince, Skruf, TreAnkrare, Camel Snus Original, Camel Snus Frost and Camel Snus Spice. The tobacco formulation may be contained in pouches and packaged, in a manner and using the types of components used for the manufacture of conventional snus types of products. The pouch or fleece provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

In certain embodiments, an exemplary pouch may be manufactured from materials, and in such a manner, such that during use by the user, the pouch is undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes toss of its physical integrity. If desired, flavoring ingredients, disintegration aids, and other desired components, may be incorporated within, or applied to, the pouch material.

Descriptions of various components of snus types of products and components thereof also are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. App. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmBH, which may be suitably modified with a capsule insertion apparatus of the general type set forth in U.S. Pat. Pub. No. 2007/0068540 to Thomas et al. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

The pouches containing the tobacco formulation are preferably packaged in an outer container that is sealed tightly, and is composed of a suitable material, such that the atmospheric conditions within that sealed package are modified and/or controlled. That is, the sealed package can provide a good barrier that inhibits the passage of compositions such as moisture and oxygen therethrough. In addition, the atmosphere within the sealed package can be further modified by introducing a selected gaseous species (e.g., nitrogen, argon, or a mixture thereof) into the package prior to sealing. As such, the atmospheric conditions to which the tobacco composition is exposed are controlled during conditions of preparation, packing, storage and handling.

The present invention can involve the use of equipment, materials, methodologies and process conditions that are suitably modified in order to provide the packaging and controlled atmospheric conditions for the tobacco products that are packaged pursuant thereto. The atmosphere within the packaging materials can be modified in a variety of ways. For example, a significant amount of the atmosphere within the package can be removed (e.g., by using vacuum packaging types of techniques), or the atmosphere within the package can be altered in a controlled manner (e.g., by using gas flushing types of techniques). Representative aspects of various technologies associated with modified atmosphere packaging and controlled atmosphere packaging are set forth in Analysis and Evaluation of Preventative Control Measures for the Control and Reduction/Elimination of Microbial Hazards on Fresh and Fresh-Cut Product; Chapter VI; Microbiological Safety of Controlled and Modified Atmosphere Packaging of Fresh and Fresh-Cut Product; U.S. Food and Drug Administration, Center for Food Safety and Applied Nutrition (Sep. 30, 2001); which is incorporated herein by reference.

The controlled or modified atmospheres within packaged tobacco products of the present invention can vary. Typically, when tobacco product is vacuum packed or flushed so as to have a controlled or modified atmosphere (e.g., even if the atmosphere is controlled in a manner such that the atmospheric pressure within the sealed package is at a positive pressure relevant to ambient atmospheric pressure), atmospheric conditions within the package are controlled such that a significant amount, and most preferably virtually all of the oxygen present within with package, is removed from that package prior to the time that the package is sealed. That is, less than about 8 percent, and often less than about 6 percent, of the weight of the controlled atmosphere initially present with a sealed outer package is composed of oxygen. For example, when the package is sealed, the atmosphere present within the package preferably can possess less than about 5 percent oxygen, and most preferably between about 1 percent oxygen and about 5 percent oxygen, based on the weight of the controlled atmosphere initially present within that sealed package. Typically, when the tobacco product is flushed with a gaseous species (e.g., a selected gas or mixture of gases), a significant amount, and most preferably virtually all, of the atmosphere within the sealed package is provided by the desired gaseous species. Exemplary gaseous species include nitrogen, argon, carbon dioxide, and the like (e.g., high purity gases that are greater than about 99 percent pure, by weight). Alternatively, the atmosphere to which the tobacco product incorporates a relatively high level of a desired gaseous species (e.g., oxygen) in order to introduce the effects of "gas shock" to the tobacco product (e.g., relatively high levels of oxygen in the atmosphere can be desirable for the introduction of "oxygen shock" for purposes of inhibiting enzymatic discoloration, preventing anaerobic fermentation reactions, and inhibiting aerobic and anaerobic microbial growth). For example, a controlled atmosphere containing an amount of oxygen such that the level of oxygen in that atmosphere greater than about 25 percent by weight, often greater than about 30 percent by weight, can provide conditions suitable for introduction of oxygen shock.

Representative equipment useful for carrying out process steps associated with the packaging processes described herein is available from Winpak Ltd. (e.g., systems identified as LD32, L25, L18 and L12); as Linium 300 Series horizontal flow wrapping systems from Doboy Inc. (e.g., Linium Model Nos. 301, 302, 303, 304 or 305); as Hiwrap 504 systems available from Hitech Systems s.r.l.; and as the types of systems available from Rovema Verpackungmaschinen GmbH. Preferred equipment provides a wrapping material that provides a seal that does not allow passage of gases or moisture therethrough (e.g., a seal that might be considered as "air tight").

The pouches containing the tobacco formulation, whether optionally further sealed in an airtight outer package as discussed above or not, can be packaged within a sealed hard container that serves as the outermost package or container. A representative hard container is the short, rounded edge, generally cylindrical container traditionally used for the marketing of snus types of products. See, for example, the types of representative snuff-box types of designs set forth in PCT WO 2005/016036 to Bjorkholm. Other types of containers that can be suitably modified are plastic or metal type containers set forth in U.S. Pat. No. 7,014,039 to Henson et al. See, also, the types of hard containers used for the commercial distribution of Camel Snus by R. J. Reynolds Tobacco Company; Revel Mint Tobacco Packs type of smokeless tobacco product by U.S. Smokeless Tobacco Corporation; SkoalDry by U.S. Smokeless Tobacco Co. and "taboka" by Philip Morris USA. If desired, the type of container used for the "toboka" product can be adapted to possess a slidable tip lid (e.g., that slides generally parallel to the longitudinal axis of the container) in order that the container can be opened and closed. If desired, the container can have an accordion or bellows type of design; and as such, the container can be extended open for filling with smokeless tobacco product during production, and then contracted after filling of the container is complete. If desired, containers can be equipped with suitable seals or grommets, such that when an opened container is re-shut, a good seal is provided.

In use, the hard container is opened, the outer package is opened, a pouch is removed therefrom, and the pouch is enjoyed by the consumer. The hard container is manually resealed, and additional pouches are removed from that container by the consumer as desired.

The amount of tobacco formulation incorporated within each sealed outer package can vary. In one aspect, loose tobacco composition can be incorporated into an outer package, the package is sealed, and that loose tobacco can be used as loose snuff or chewing tobacco when the outer package is opened. In another, but preferred, aspect, tobacco composition contained within a snus-type pouch or packet is incorporated within the outer package, the package is sealed, and the snus-type product can be used when the outer package is opened.

Typically, the amount of tobacco formulation within each individual portion (e.g., within each pouch) is such that there is at least about 50 mg, often at least about 150 mg, and frequently at least about 250 mg, of dry weight tobacco; and less than about 700 mg, often less than about 500 mg, and frequently less than about 300 mg, of dry weight tobacco. For example, snus-type smokeless tobacco products can have the form of so-called "portion snus." In one typical embodiment, the amount of tobacco formulation within each pouch is between about 100 mg and about 400 mg.

One exemplary snus-type product possesses about 1 g of a tobacco formulation having a moisture content of about 35 weight percent; which tobacco formulation is contained in a sealed fleece pouch having an overall length of about 30 mm, a width of about 16 mm, and a height of about 5 mm, wherein the length of the compartment area of that pouch is about 26 mm due to a seal of about 2 mm width at each end of that pouch. Another exemplary snus-type product possesses about 0.5 g of a tobacco formulation having a moisture content of about 35 weight percent; which tobacco formulation is contained in a sealed fleece pouch having an overall length of about 26 mm, a width of about 12 mm, and a height of about 5 mm, wherein the length of the compartment area of that pouch is about 22 mm due to a seal of about 2 mm width at each end of that pouch.

Descriptions of various components of snus types of products and components thereof, as well as packaging structures for snus products, also are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr; U.S. Pat. App. Pub. Nos. 2005/0061339 to Hansson et al.; 2007/0095356 to Winterson et al.; and 2007/0062549 to Holton, Jr. et al.; PCT WO 2007/057789 to Sweeney et al.; WO 2007/057791 to Neidle et al.; and U.S. application Ser. Nos. 11/461,633 to Mua et al. and 11/461,628 to Robinson et al., both filed Aug. 1, 2006, each of which is incorporated herein by reference. See, also, the types of pouches set forth in U.S. Pat. No. 5,167,244 to Kjerstad, which is incorporated herein by reference.

Products of the present invention may be packaged and stored in much the same manner that conventional types of smokeless tobacco products are packaged and stored. For example, a plurality of packets or pouches may be contained in a cylindrical container. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

The following examples are provided to illustrate further aspects associated with the present invention, but should not be construed as limiting the scope thereof. Unless otherwise noted, all parts and percentages are by weight.

EXPERIMENTAL

Example 1

A moist tobacco formulation suitable for use as a snus type of smokeless tobacco product is provided in the following manner.

Various types of tobacco material are combined. A preblend of several lamina components is made and metered into an AeroFlex Model A115 flexible screw conveyor (Vac-U-Max Company, Belleville, N.J.). The flexible screw feeder discharges directly to a Fitzmill Comminutor hammer mill (Fitzpatrick, Elmhurst Ill.) utilizing a concave with 0.125 inch diameter holes. The milled lamina is then pneumatically conveyed to a Rotex Model 44 screener (Rotex Corporation, Cincinnati, Ohio) with 2 screens—an 18 Tyler mesh and a 60 Tyler mesh. The material that does not pass through the 18 mesh screen is conveyed back into the infeed hopper for further milling and the material passing the 60 mesh is discarded. The material that passes the 18 mesh and is retained on the 60 mesh is gravity discharged into a container for further use in the process. A plurality of stem fractions (Rustica, Kurnool, and Indian Sun Cured) is milled separately to the same size as the lamina using the same equipment noted above.

An amount of each material (lamina, Indian Sun Cured Stem, Rustica Stem, Kurnool Stem) is loaded into a Scott Mixer. The mixer shaft rotates at 73 rpm for a minimum of 5 minutes during the mixing/blending step. Tobacco moisture is 11.43% (by weight) with a pH of 5.23.

The tobacco is heated by passing heated water at 97° C. through the water jacket on the Scott Mixer to obtain a tobacco temperature of 65° C. prior to applying the first casing. Mixer shaft speed is 73 rpm during the heating step.

Sodium chloride and water are placed in a Breddo Likwifier Model LORWW mixer and mixed for a minimum time of 3 minutes. The casing is then pumped into the mixer via an ARO air operated Diaphragm pump at a flow rate of 4 gpm. The casing is introduced into the Scott Mixer via a Spraying Systems Corporation Model ½ GD SS-16 hydraulic atomizing nozzle. The mixer speed is 73 rpm and the tobacco temperature is controlled at 65° C. during this step by applying either hot water or chilled water to the mixer water jacket. The mixer runs for a minimum of 10 minutes to ensure proper mixing of the first casing and the tobacco. Tobacco moisture at the end of this step is 35.95% with a pH of 5.30.

The temperature set point on the water jacket is raised to 88° C. to minimize condensation during the heating phase. Steam is directly injected into the Scott mixer via two nozzles, one mounted on each end of the vessel. The steam is injected to raise and maintain the tobacco temperature to at least 93° C. and is held at this temperature for a minimum of 60 minutes. Mixer speed is 10 rpm during this step. Tobacco moisture at the end of this step is 40.23% with a pH of 5.22.

After pasteurization is completed the tobacco is cooled to 65° C. prior to applying the second casing. The cooling step is accomplished by both evaporative and convective cooling. A fan is utilized to introduce filtered room air at ambient temperature into the Scott Mixer in order to evaporatively cool the tobacco and chilled water at a temperature of 3° C. is introduced to the water jacket to also cool the tobacco. Mixer speed is 10 rpm during this step.

A second casing solution comprising water and sodium carbonate is placed in a Breddo Likwifier Model LORWW mixer and mixed for a minimum time of 3 minutes. The casing is then pumped into the mixer via an ARO air operated Diaphragm pump at a flow rate of 4 gpm. The casing is introduced into the Scott Mixer via a Spraying Systems Corporation Model ½ GD SS-16 hydraulic atomizing nozzle. The mixer speed is 73 rpm and the tobacco temperature is controlled at 65° C. during this step by applying either hot water or chilled water to the mixer water jacket. The mixer runs for a minimum of 5 minutes to ensure proper mixing of the second casing and the tobacco. The tobacco moisture at the end of this step is 51.62% with a pH of 8.72.

After addition of the second casing, the Scott mixer is held at a constant 71° C. temperature for 2 hours using the water jacket. A small flow of filtered air is passed through the Scott Mixer to purge the head space. Mixer speed is 10 rpm during this step. Tobacco moisture at the end of this step is 49.36% with a pH of 8.34.

After completion of the above step, the batch is dried at a constant 38° C. for a period of 20 hours by passing hot water at 54° C. through the waterjacket and passing filtered air through the Scott Mixer. Mixer speed is 10 rpm during this step. Tobacco moisture at the end of this step is 31.08% with a pH of 7.90.

After drying, the tobacco is cooled to 29° C. prior to applying the third casing by passing chilled water at 3° C. through the water jacket. Mixer speed is 10 rpm during this step. Tobacco moisture at the end of this step is 30.85% with a pH of 7.89.

The third casing solution, which comprises a sweetener, is placed in a Breddo Likwifier Model LORWW mixer and mixed for a minimum time of 3 minutes. The casing is then pumped into the mixer via an ARO air operated Diaphragm pump at a flow rate of 4 gpm. The casing is introduced into the Scott Mixer via a Spraying Systems Corporation Model ½ GD SS-16 hydraulic atomizing nozzle. Mixer speed is 73 rpm and the tobacco temperature is controlled at 29° C. during this step by passing chilled water through the mixer water jacket. The mixer runs for a minimum of 15 minutes to ensure proper mixing of the third casing and the tobacco. Tobacco moisture at the end of this step is 34.23% with a pH of 7.87.

After applying the third casing, the tobacco is maintained at 29° C. by passing chilled water at 3° C. through the water jacket. Mixer speed is 10 rpm during this step. Tobacco moisture at the end of this step is 34.23% with a pH of 7.87.

A top dressing flavorant material is placed in a pressurized blow pot. The top dressing is then pumped into the mixer via air pressure on the blow pot at a flow rate of 4 gpm. The top dressing is introduced into the Scott Mixer via a Spraying Systems Corporation Model ½ GD SS-16 hydraulic atomizing nozzle. Mixer speed is 73 rpm and the tobacco temperature is controlled at 29° C. during this step by passing chilled water through the mixer water jacket. The mixer runs for a minimum of 15 minutes to ensure proper mixing of the top dressing and the tobacco. Tobacco moisture at the end of this step is 36.53% with a pH of 7.84. The resulting product is stored at 3° C. and is ready for pouching.

Example 2

A moist tobacco formulation suitable for use as a snus type of smokeless tobacco product is provided in the following manner.

A dry, milled tobacco material blend as set forth in Example 1 is provided. To the dry tobacco mixture is added water. The moisture can be provided in the form of water at ambient temperature or heated. The water can incorporate ingredients dispersed or dissolved therein. For example, a solution of sodium chloride dissolved in water can be added to the dry tobacco mixture in an amount sufficient to achieve an amount of sodium chloride in the tobacco material of about 1 to about 8% by weight, based on the dry weight of the tobacco. As such, sufficient water is added to the tobacco mixture such that the tobacco mixture is in slurry form and has a moisture content of 1 weight part tobacco to about 4 to about 10 weight parts waters (e.g., 1 part tobacco:4 to 5 part water).

The tobacco material slurry is heated to about 75° C. and mixed at a speed of 24 rpm. Then, the convective and conductive heating of the tobacco mixture is complemented by the addition of steam to the mixture. In particular, steam is blown into contact with the tobacco mixture using nozzles present in the mixer. The temperature of the mixture is held at about 75° C. for about 30 minutes to about 45 minutes, while still being mixed at 24 rpm. The moisture content of the tobacco slurry can be controlled during steam treatment by control of the jacket temperature. For example, lowering the jacket temperature during steam treatment can increase the moisture content of the tobacco mixture.

A base, such as potassium or sodium hydroxide, is added to the tobacco slurry in the form of an aqueous solution. For example, to achieve a final slurry pH of about 10, sufficient potassium hydroxide is added to achieve a concentration of potassium hydroxide of about 6% to about 8% by weight, based on the dry weight to of the tobacco. The mixture is maintained at an elevated temperature of about 75° C. for about 1.5 hours to 3 hours. During that period, the pH of the mixture drops to about 8.2 to about 8.3.

The tobacco slurry is cooled to ambient temperature and, during cooling, glycerol is added in an amount of about 3 to about 8%, based on the dry weight of the tobacco. The resulting mixture is cast onto a hot aluminum or stainless steel belt and dried to a moisture content of about 10-12% by weight by passing the tobacco material through a drying zone operated at a temperature of 85° C. to 285° C.

The resulting dried tobacco material is placed within a mixer and water and a sweetener are added in order to raise the moisture level to at least about 30% by weight. A final top dressing flavorant is sprayed onto the moist tobacco. The resulting tobacco is cooled to ambient temperature, stored at 3° C., and is ready for pouching.

Example 3

A moist tobacco formulation suitable for use as a snus type of smokeless tobacco product is provided in the following manner.

Tobacco is treated in a similar manner to that for a paper process reconstituted tobacco, such as described in U.S. Pat. Nos. 5,159,942 and 5,445,169 to Brinkley, with some modification. Tobacco (1 part) is subjected to an aqueous extraction (11 parts water) at 75° C. for about 45 min by mixing at 24 rpm, and the solids/fibers are separated by centrifugation from the weak extract (about 3-6% solids). The aqueous solution used to extract the tobacco contains about 3.5% salt (sodium chloride) and about 1% base (sodium hydroxide) by weight of tobacco. The weak extract is cooled down to about 65° C. and then neutralized by addition of a base (e.g., about 3.5% sodium hydroxide and about 3.5% potassium carbonate by weight of tobacco), while mixing at a speed of 10 rpm for about 1.5 h or more. During mixing, the pH of the extract changes from about 9.2 to about 8.2, after which the weak extract is concentrated to an about 30-35% solids strong extract via vacuum evaporation. After evaporation, the strong extract is mixed with about 6% glycerin humectant, and then added back to the extracted fibers, before being dried to about 10 to about 12% moisture in a forced air oven (at a temperature of about 85 to about 100° C.).

The resulting dried tobacco material is placed within a mixer and water and a sweetener are added in order to raise the moisture level to at least about 30% by weight. A final top dressing flavorant is sprayed onto the moist tobacco. The resulting tobacco is cooled to ambient temperature, stored at 3° C., and is ready for pouching.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A process for preparing a tobacco composition suitable for use as a smokeless tobacco composition, comprising:

providing a slurry comprising water and a tobacco material, the slurry comprising at least about 75% by weight water, based on the total weight of the slurry;

heating the slurry to a temperature of at least about 60° C. for a time sufficient to pasteurize the tobacco material;

adding an amount of a base to the slurry sufficient to raise the pH of the slurry to at least about 8.5, thereby forming a pH-adjusted slurry; and continuing to heat the pH-adjusted slurry to a temperature of at least about 60° C. for a time sufficient for the pH of the slurry to drop at least about 0.5 pH unit following said adding step.

2. The process of claim 1, further comprising the step of adding a salt to the slurry prior to said heating step.

3. The process of claim 2, wherein said salt addition step comprises adding about 1 to about 5% by weight of a sodium chloride, based on the dry weight of the tobacco material.

4. The process of claim 1, further comprising cooling the slurry to a temperature of less than about 35° C.

5. The process of claim 4, further comprising the step of adding a humectant during or following said cooling step.

6. The process of claim 1, further comprising the step of drying the slurry to a moisture content of no more than about 15% by weight, based on the total weight of the dried tobacco material.

7. The process of claim 6, further comprising the step of adding one or more flavorants and additional moisture to the dried tobacco material in an amount sufficient to raise the moisture content of the tobacco material to at least about 25% by weight.

8. The process of claim 1, wherein said step of providing a slurry comprises providing a slurry having a water content of at least about 80% by weight of the slurry.

9. The process of claim 8, wherein the water content of the slurry is about 80 to about 95% by weight.

10. The process of claim 1, wherein said slurry heating step comprises heating the slurry to a temperature of at least about 70° C. for at least about 30 minutes.

11. The process of claim 1, wherein said step of continuing to heat the pH-adjusted slurry comprises heating the pH-adjusted slurry for at least about 1.5 hours.

12. The process of claim 1, wherein said adding step comprises adding sufficient base to raise the pH of the slurry to at least about 9.

13. The process of claim 1, wherein the base is selected from the group consisting of alkali metal hydroxides, alkali metal carbonates, alkali metal bicarbonates, and mixtures thereof.

14. The process of claim 13, wherein the base is selected from the group consisting of sodium carbonate, potassium carbonate, sodium bicarbonate, potassium bicarbonate, sodium hydroxide, potassium hydroxide, and mixtures thereof.

15. The process of claim 1, wherein the rate of pH reduction is maintained at about 0.05 to about 0.15 pH units per hour following said adding step.

16. The process of claim 15, wherein the rate of pH reduction is maintained at about 0.08 to about 0.10 pH units per hour following said adding step.

17. A process for preparing a tobacco composition suitable for use as a smokeless tobacco composition, comprising:

providing a slurry comprising water and a tobacco material, the slurry comprising at least about 80% by weight water, based on the total weight of the slurry;

heating the slurry to a temperature of at least about 70° C. for a time sufficient to pasteurize the tobacco material;

adding an amount of a base to the slurry sufficient to raise the pH of the slurry to at least about 9, thereby forming a pH-adjusted slurry;

continuing to heat the pH-adjusted slurry to a temperature of at least about 60° C. for a time sufficient for the pH of the slurry to drop at least about 0.5 pH unit following said adding step; and cooling the pH-adjusted slurry to about ambient temperature, the pH-adjusted slurry having a pH of at least about 8 at the time the cooling step begins.

18. A process for preparing a tobacco composition suitable for use as a smokeless tobacco composition, comprising:

providing a slurry comprising water and a tobacco material, the slurry comprising at least about 80% by weight water, based on the total weight of the slurry;

heating the slurry to a temperature of at least about 70° C. for at least about 30 minutes;

adding an amount of a base to the slurry sufficient to raise the pH of the slurry to at least about 9.5, thereby forming a pH-adjusted slurry;

continuing to heat the pH-adjusted slurry to a temperature of at least about 60° C. for at least about 1.5 hours;

cooling the pH-adjusted slurry to about ambient temperature, the pH-adjusted slurry having a pH of at least about 8 at the time the cooling step begins;

adding a humectant to the pH-adjusted slurry during or after said cooling step; and drying the pH-adjusted slurry at a temperature and for a time sufficient to decrease the moisture level of the tobacco material to less than about 15% by weight, based on the weight of the moist tobacco material.

* * * * *